US007883392B2

(12) United States Patent
Van de Rostyne et al.

(10) Patent No.: US 7,883,392 B2
(45) Date of Patent: Feb. 8, 2011

(54) TOY HELICOPTER

(75) Inventors: Alexander Jozef Magdalena Van de Rostyne, Bornem (BE); Kwok Leung Wong, Hong Kong (HK)

(73) Assignee: Silverlit Toys Manufactory Ltd., Causeway Bay (HK)

( * ) Notice: Subject to any disclaimer, the term of this patent is extended or adjusted under 35 U.S.C. 154(b) by 203 days.

(21) Appl. No.: 12/185,277

(22) Filed: Aug. 4, 2008

(65) Prior Publication Data

US 2010/0025525 A1 Feb. 4, 2010

(51) Int. Cl.
*A63H 27/127* (2006.01)

(52) U.S. Cl. ..... 446/36; 446/34; 446/37; 446/58; 446/66; 244/17.11

(58) Field of Classification Search ..... 446/34, 446/36, 37, 66, 68, 57; 244/17.19, 17.11
See application file for complete search history.

(56) References Cited

U.S. PATENT DOCUMENTS

| | | | | |
|---|---|---|---|---|
| 934,771 | A | 9/1909 | Turnbull | |
| 1,403,909 | A | 1/1922 | Moir | |
| 1,446,522 | A | 2/1923 | Smith | |
| 1,446,718 | A | 2/1923 | Newbauer | |
| 1,470,017 | A | 10/1923 | Lougheed | |
| 1,494,454 | A * | 5/1924 | Wanner | 446/64 |
| 1,773,281 | A | 8/1930 | Scott | |
| 1,800,470 | A | 4/1931 | Oehmichen | |
| 1,828,783 | A | 10/1931 | Oehmichen | |
| 1,925,156 | A | 9/1933 | Vaughn | |
| 2,030,578 | A | 2/1936 | Flettner | |
| 2,110,563 | A | 3/1938 | Thaon | |
| 2,272,643 | A | 2/1942 | Peters et al. | |
| 2,275,094 | A * | 3/1942 | Taylor | 446/66 |
| 2,307,381 | A | 1/1943 | Bess | |
| D140,480 | S | 2/1945 | Maycen | |
| 2,368,698 | A | 2/1945 | Young | |
| 2,384,516 | A | 9/1945 | Young | |
| 2,411,596 | A | 11/1946 | Shapiro | |
| 2,413,831 | A | 1/1947 | Jordan | |
| 2,429,502 | A | 10/1947 | Young | |
| D149,130 | S | 3/1948 | Katenberter et al. | |
| 2,439,143 | A | 4/1948 | Nemeth | |

(Continued)

FOREIGN PATENT DOCUMENTS

| | | |
|---|---|---|
| BE | 338599 | 12/1926 |

(Continued)

OTHER PUBLICATIONS

Photographic prior art reference #1, helicopter.

(Continued)

*Primary Examiner*—Gene Kim
*Assistant Examiner*—Scott Young
(74) *Attorney, Agent, or Firm*—Greenberg Traurig, LLP

(57) ABSTRACT

A toy helicopter, in accordance with the present disclosure, includes a body having a longitudinal length and a main rotor. There is an element movable along the longitudinal length. The element allows a user to selectively adjust the location of the center of gravity of a toy helicopter by moving the element along the longitudinal length, thereby changing the velocity of the helicopter.

6 Claims, 29 Drawing Sheets

U.S. PATENT DOCUMENTS

| | | | | | |
|---|---|---|---|---|---|
| D153,314 | S | | 4/1949 | Piasecki | |
| D153,315 | S | | 4/1949 | Piasecki | |
| D153,316 | S | | 4/1949 | Piasecki | |
| D153,317 | S | | 4/1949 | Piasecki | |
| 2,466,821 | A | | 4/1949 | Owen | |
| 2,469,144 | A | | 5/1949 | Baggott | |
| 2,481,750 | A | | 9/1949 | Hiller, Jr. et al. | |
| 2,486,059 | A | | 10/1949 | Pentecost | |
| 2,487,020 | A | | 11/1949 | Gilcrease | |
| 2,514,822 | A | | 7/1950 | Wolfe, Jr. | |
| 2,532,683 | A | | 12/1950 | Traver | |
| 2,554,938 | A | | 5/1951 | Catalano | |
| D163,938 | S | | 7/1951 | Douglas | |
| 2,563,731 | A | | 8/1951 | Masterson | |
| 2,599,957 | A | * | 6/1952 | Walker | 446/68 |
| 2,614,637 | A | | 10/1952 | Landgraf | |
| 2,629,568 | A | | 2/1953 | Croshere, Jr. et al. | |
| 2,629,570 | A | | 2/1953 | Carnahan | |
| 2,633,924 | A | | 4/1953 | Young | |
| 2,639,874 | A | | 5/1953 | Stalker | |
| 2,646,848 | A | | 7/1953 | Young | |
| D171,569 | S | | 3/1954 | Apostolescu | |
| 2,725,494 | A | | 11/1955 | Anderson | |
| D178,081 | S | | 6/1956 | Papadakos | |
| 2,750,131 | A | | 6/1956 | Thomson | |
| 2,801,494 | A | | 8/1957 | Ernst | |
| D181,643 | S | | 12/1957 | Graham | |
| 2,818,123 | A | | 12/1957 | Hiller, Jr. | |
| 2,822,994 | A | | 2/1958 | Warto | |
| D184,501 | S | | 2/1959 | Wlaschin et al. | |
| 2,923,494 | A | | 2/1960 | Strong | |
| D187,625 | S | | 4/1960 | Apostolescu | |
| D187,895 | S | | 5/1960 | Douglas | |
| 2,950,074 | A | | 8/1960 | Apostolescu | |
| 2,980,187 | A | | 4/1961 | Smyth-Davila | |
| 2,987,848 | A | | 6/1961 | Neuhaus et al. | |
| 3,029,048 | A | * | 4/1962 | Brooks et al. | 244/17.19 |
| 3,035,643 | A | | 5/1962 | Kelley et al. | |
| 3,068,611 | A | | 12/1962 | Lauderdale | |
| 3,080,001 | A | | 3/1963 | Culver et al. | |
| 3,093,929 | A | | 6/1963 | Robbins et al. | |
| 3,106,964 | A | | 10/1963 | Culver et al. | |
| 3,116,896 | A | | 1/1964 | Sigler et al. | |
| 3,135,334 | A | | 6/1964 | Culver | |
| 3,180,424 | A | | 4/1965 | Serriades | |
| 3,213,944 | A | | 10/1965 | Nichols et al. | |
| 3,228,478 | A | | 1/1966 | Edenborough | |
| 3,231,222 | A | | 1/1966 | Scheutzow | |
| D205,326 | S | | 7/1966 | Postelson-Apostolescu | |
| 3,321,022 | A | | 5/1967 | Oguri | |
| 3,370,809 | A | | 2/1968 | Leoni | |
| 3,371,886 | A | | 3/1968 | Schertz | |
| 3,391,746 | A | * | 7/1968 | Cardoso | 416/128 |
| 3,409,249 | A | | 11/1968 | Bergquist et al. | |
| 3,448,810 | A | | 6/1969 | Vogt | |
| 3,450,374 | A | | 6/1969 | Moore | |
| 3,460,628 | A | | 8/1969 | Tankersley | |
| 3,481,559 | A | | 12/1969 | Apostolescu | |
| 3,554,467 | A | | 1/1971 | Yowell | |
| 3,558,081 | A | | 1/1971 | Williams | |
| 3,572,616 | A | | 3/1971 | Ulisnik | |
| 3,592,559 | A | | 7/1971 | Ward | |
| D221,453 | S | | 8/1971 | Swanberg | |
| 3,625,631 | A | | 12/1971 | Covington, Jr. et al. | |
| 3,662,487 | A | | 5/1972 | Seefluth | |
| 3,759,629 | A | | 9/1973 | Abramopaulos | |
| 3,771,924 | A | | 11/1973 | Buchstaller | |
| D232,168 | S | | 7/1974 | Leoni | |
| D232,170 | S | | 7/1974 | Diamond et al. | |
| D234,350 | S | | 2/1975 | Beckert et al. | |
| 3,905,565 | A | | 9/1975 | Kolwey | |
| 3,933,324 | A | | 1/1976 | Ostrowski | |
| D239,930 | S | | 5/1976 | Ulisnik | |
| 4,025,230 | A | | 5/1977 | Kastan | |
| 4,053,123 | A | | 10/1977 | Chadwick | |
| 4,073,086 | A | | 2/1978 | Ogawa | |
| 4,084,345 | A | | 4/1978 | Tanaka | |
| 4,118,143 | A | | 10/1978 | Kavan | |
| 4,133,500 | A | * | 1/1979 | Chapman | 244/153 R |
| 4,142,697 | A | | 3/1979 | Fradenburgh | |
| D253,003 | S | | 9/1979 | Tanaka | |
| 4,173,321 | A | | 11/1979 | Eickmann | |
| 4,195,439 | A | * | 4/1980 | Kramer | 446/68 |
| 4,227,856 | A | | 10/1980 | Verrill et al. | |
| 4,307,533 | A | | 12/1981 | Sims et al. | |
| 4,519,746 | A | | 5/1985 | Wainauski et al. | |
| 4,522,563 | A | | 6/1985 | Reyes et al. | |
| 4,629,440 | A | | 12/1986 | Mckittrick et al. | |
| D287,738 | S | | 1/1987 | Bollinger et al. | |
| D294,605 | S | | 3/1988 | Matsumoto | |
| 4,759,514 | A | | 7/1988 | Burkam | |
| 4,880,355 | A | | 11/1989 | Vuillet et al. | |
| 4,941,803 | A | | 7/1990 | Wainauski et al. | |
| 4,981,456 | A | | 1/1991 | Sato et al. | |
| 5,015,187 | A | | 5/1991 | Lord | |
| 5,108,043 | A | | 4/1992 | Canavespe | |
| 5,151,014 | A | | 9/1992 | Greenwald et al. | |
| 5,183,960 | A | * | 2/1993 | Shires | 102/348 |
| 5,190,242 | A | | 3/1993 | Nichols | |
| 5,203,520 | A | | 4/1993 | Przygodski et al. | |
| 5,209,429 | A | | 5/1993 | Doolin et al. | |
| 5,240,204 | A | * | 8/1993 | Kunz | 244/6 |
| 5,252,100 | A | | 10/1993 | Osawa et al. | |
| 5,255,871 | A | | 10/1993 | Ikeda | |
| 5,259,729 | A | | 11/1993 | Fujihira et al. | |
| 5,304,090 | A | * | 4/1994 | Vanni | 446/36 |
| 5,370,341 | A | | 12/1994 | Leon | |
| 5,383,805 | A | * | 1/1995 | Tsai | 446/66 |
| 5,388,785 | A | * | 2/1995 | Rollet et al. | 244/17.19 |
| 5,395,275 | A | | 3/1995 | Johnson et al. | |
| D357,894 | S | | 5/1995 | Arnold et al. | |
| 2,720,928 | A | | 10/1995 | Warto | |
| 5,505,407 | A | | 4/1996 | Chiappetta | |
| 5,511,947 | A | | 4/1996 | Schmuck | |
| D372,741 | S | | 8/1996 | Tsai | |
| D378,606 | S | | 3/1997 | Tamagnini | |
| 5,609,312 | A | * | 3/1997 | Arlton et al. | 244/17.11 |
| 5,628,620 | A | | 5/1997 | Arlton | |
| D388,048 | S | | 12/1997 | Taylor et al. | |
| D390,942 | S | | 2/1998 | Mei | |
| 5,749,540 | A | | 5/1998 | Arlton | |
| 5,836,545 | A | | 11/1998 | Arlton et al. | |
| 5,879,131 | A | | 3/1999 | Arlton et al. | |
| 5,906,476 | A | | 5/1999 | Arlton | |
| 5,915,649 | A | | 6/1999 | Head | |
| 5,971,320 | A | | 10/1999 | Jermyn et al. | |
| 6,000,911 | A | | 12/1999 | Toulmay et al. | |
| D421,279 | S | | 2/2000 | Tsai | |
| 6,032,899 | A | | 3/2000 | Mondet et al. | |
| 6,039,541 | A | | 3/2000 | Parker et al. | |
| D425,853 | S | | 5/2000 | Caporaletti | |
| 6,086,016 | A | | 7/2000 | Meek | |
| 6,302,652 | B1 | | 10/2001 | Roberts | |
| 6,398,618 | B1 | | 6/2002 | Wu | |
| 6,435,453 | B1 | | 8/2002 | Carter, Jr. | |
| 6,460,802 | B1 | | 10/2002 | Norris | |
| 6,467,726 | B1 | | 10/2002 | Hosoda | |
| D467,861 | S | | 12/2002 | Lee | |
| 6,499,690 | B1 | | 12/2002 | Katayama et al. | |
| 6,543,726 | B2 | | 4/2003 | Illingworth | |
| 6,632,119 | B2 | | 10/2003 | Chernek et al. | |
| 6,659,395 | B2 | | 12/2003 | Rehkemper et al. | |
| 6,659,721 | B1 | | 12/2003 | Parker et al. | |
| 6,688,936 | B2 | | 2/2004 | Davis | |

| | | | | |
|---|---|---|---|---|
| 6,702,552 | B1 | 3/2004 | Harman | |
| 6,719,244 | B1 | 4/2004 | Gress | |
| 6,732,973 | B1 | 5/2004 | Rehkemper | |
| 6,745,977 | B1 | 6/2004 | Long et al. | |
| 6,749,401 | B2 | 6/2004 | Vanmoor | |
| 6,758,436 | B2 | 7/2004 | Rehkemper et al. | |
| D496,695 | S | 9/2004 | Davis | |
| 6,789,764 | B2 | 9/2004 | Bass et al. | |
| 6,843,699 | B2 | 1/2005 | Davis | |
| 6,884,034 | B1 | 4/2005 | Parker et al. | |
| 6,886,777 | B2 | 5/2005 | Rock | |
| 6,896,225 | B2 * | 5/2005 | Tabor | 244/153 R |
| 6,899,586 | B2 | 5/2005 | Davis | |
| 6,929,215 | B2 | 8/2005 | Arlton | |
| 6,938,853 | B2 | 9/2005 | Pines et al. | |
| 6,960,112 | B2 | 11/2005 | Helmlinger et al. | |
| 6,978,969 | B1 | 12/2005 | Neal | |
| D524,227 | S | 7/2006 | Stille et al. | |
| D524,228 | S | 7/2006 | Scott et al. | |
| D524,229 | S | 7/2006 | Stille et al. | |
| D524,230 | S | 7/2006 | Stille et al. | |
| D524,718 | S | 7/2006 | Scott et al. | |
| 7,100,866 | B2 | 9/2006 | Rehkemper et al. | |
| 7,178,757 | B1 | 2/2007 | Breese et al. | |
| 7,178,758 | B2 | 2/2007 | Rehkemper | |
| 7,188,803 | B2 | 3/2007 | Ishiba | |
| 7,198,223 | B2 | 4/2007 | Phelps, III et al. | |
| 7,204,453 | B2 | 4/2007 | Muren | |
| D544,825 | S | 6/2007 | Van de Rostyne et al. | |
| D545,755 | S | 7/2007 | Van de Rostyne et al. | |
| D546,269 | S | 7/2007 | Van de Rostyne et al. | |
| 7,246,769 | B2 | 7/2007 | Yoeli | |
| D548,803 | S | 8/2007 | Zimet | |
| 7,255,623 | B2 | 8/2007 | Davis | |
| 7,264,199 | B2 | 9/2007 | Zientek | |
| 7,273,195 | B1 | 9/2007 | Golliher | |
| D552,531 | S | 10/2007 | Van de Rostyne et al. | |
| D554,040 | S | 10/2007 | Van de Rostyne et al. | |
| 7,306,186 | B2 | 12/2007 | Kusic | |
| D559,764 | S | 1/2008 | Wai | |
| D561,084 | S | 2/2008 | Wai | |
| D561,085 | S | 2/2008 | Wai | |
| D561,676 | S | 2/2008 | Wai | |
| D561,677 | S | 2/2008 | Wai | |
| D561,678 | S | 2/2008 | Wai | |
| D561,679 | S | 2/2008 | Wai | |
| D568,947 | S | 5/2008 | Van De Rostyne et al. | |
| D576,215 | S | 9/2008 | Van De Rostyne et al. | |
| 7,422,505 | B2 | 9/2008 | Van de Rostyne | |
| 7,425,167 | B2 | 9/2008 | Van de Rostyne | |
| 7,425,168 | B2 | 9/2008 | Van de Rostyne | |
| D579,403 | S | 10/2008 | Van de Rostyne et al. | |
| D580,343 | S | 11/2008 | Van de Rostyne et al. | |
| D580,344 | S | 11/2008 | Wai | |
| D580,845 | S | 11/2008 | Van de Rostyne et al. | |
| D581,341 | S | 11/2008 | Van de Rostyne et al. | |
| D581,856 | S | 12/2008 | Van de Rostyne et al. | |
| D582,336 | S | 12/2008 | Van de Rostyne et al. | |
| D582,833 | S | 12/2008 | Van de Rostyne et al. | |
| D583,297 | S | 12/2008 | Van de Rostyne et al. | |
| 7,467,984 | B2 | 12/2008 | Van de Rostyne | |
| D585,810 | S | 2/2009 | Van de Rostyne et al. | |
| 7,494,397 | B2 | 2/2009 | Van de Rostyne | |
| 7,497,759 | B1 | 3/2009 | Davis | |
| 2002/0008759 | A1 | 1/2002 | Hoyos | |
| 2002/0049518 | A1 | 4/2002 | Yamamoto | |
| 2002/0109044 | A1 | 8/2002 | Rock | |
| 2002/0134883 | A1 | 9/2002 | Stamps et al. | |
| 2004/0087241 | A1 | 5/2004 | Agostini et al. | |
| 2004/0162001 | A1 | 8/2004 | Davis | |
| 2004/0184915 | A1 | 9/2004 | Kunii et al. | |
| 2004/0222329 | A1 | 11/2004 | Kuhns et al. | |
| 2004/0245376 | A1 | 12/2004 | Muren | |
| 2005/0061909 | A1 * | 3/2005 | Winston | 244/17.19 |
| 2005/0121552 | A1 | 6/2005 | Rehkemper | |
| 2005/0121553 | A1 * | 6/2005 | Isawa et al. | 244/17.19 |
| 2006/0102777 | A1 | 5/2006 | Rock | |
| 2006/0121819 | A1 | 6/2006 | Isawa | |
| 2006/0231677 | A1 | 10/2006 | Zimet et al. | |
| 2007/0012818 | A1 | 1/2007 | Miyazawa et al. | |
| 2007/0017724 | A1 | 1/2007 | Rajasingham | |
| 2007/0105475 | A1 * | 5/2007 | Gotou et al. | 446/37 |
| 2007/0158494 | A1 | 7/2007 | Burrage | |
| 2007/0164148 | A1 | 7/2007 | Van de Rostyne | |
| 2007/0164149 | A1 | 7/2007 | Van de Rostyne | |
| 2007/0164150 | A1 | 7/2007 | Van de Rostyne et al. | |
| 2007/0178798 | A1 * | 8/2007 | Lai | 446/36 |
| 2007/0181742 | A1 | 8/2007 | Van de Rostyne et al. | |
| 2007/0187549 | A1 | 8/2007 | Owen | |
| 2007/0215750 | A1 | 9/2007 | Shantz et al. | |
| 2007/0262197 | A1 | 11/2007 | Phelps et al. | |
| 2008/0067284 | A1 | 3/2008 | Bakker | |
| 2008/0111399 | A1 | 5/2008 | Zierten | |
| 2008/0112808 | A1 | 5/2008 | Schmaling et al. | |
| 2008/0207079 | A1 | 8/2008 | Corsiglia et al. | |
| 2008/0299867 | A1 | 12/2008 | Van de Rostyne et al. | |
| 2009/0008497 | A1 | 1/2009 | Corsiglia et al. | |
| 2009/0047861 | A1 | 2/2009 | Van de Rostyne et al. | |
| 2009/0047862 | A1 | 2/2009 | Van de Rostyne et al. | |
| 2009/0104836 | A1 | 4/2009 | Van de Rostyne et al. | |
| 2009/0117812 | A1 | 5/2009 | Van de Rostyne et al. | |
| 2009/0163110 | A1 | 6/2009 | Van de Rostyne et al. | |

FOREIGN PATENT DOCUMENTS

| | | | |
|---|---|---|---|
| BE | 1016960 | | 11/2007 |
| CN | 1496923 | A | 5/2004 |
| DE | 1 270 408 | | 6/1968 |
| DE | 24 09 227 | A1 | 9/1975 |
| DE | 40 17 402 | A1 | 12/1991 |
| DE | 94 14 652 | U1 | 11/1994 |
| DE | 203 14 041 | U1 | 4/2004 |
| DE | 102 56 916 | A | 9/2004 |
| DE | 20 2007 000987 | U1 | 4/2007 |
| EM | 000111869-0001 | | 3/2004 |
| EP | 0 250 135 | | 12/1987 |
| EP | 0 727 350 | | 8/1996 |
| EP | 1 462 362 | A1 | 9/2004 |
| EP | 1462362 | A1 | 9/2004 |
| ES | P0233821 | | 8/1957 |
| ES | P0234258 | | 9/1957 |
| ES | P0245313 | | 4/1959 |
| ES | P0283794 | | 1/1963 |
| ES | 490715 | | 4/1980 |
| ES | 275141 | | 7/1982 |
| ES | 0298826 | | 1/1989 |
| ES | 0464158 | | 1/1992 |
| ES | 2 074 010 | | 8/1995 |
| ES | 0727350 | | 8/1996 |
| ES | 1238185 | | 9/2002 |
| ES | 2172362 | | 9/2002 |
| ES | 2251668 | | 9/2004 |
| FR | 1 040 719 | A | 10/1953 |
| FR | 1 265 789 | A | 5/1961 |
| GB | 255936 | | 7/1926 |
| GB | 272871 | | 5/1927 |
| GB | 281721 | | 8/1928 |
| GB | 916894 | A | 1/1963 |
| GB | 956536 | | 4/1964 |
| GB | 958536 | | 5/1964 |
| GB | 1081341 | A | 8/1967 |
| GB | 1533251 | | 11/1978 |
| GB | 2 436 258 | A | 9/2007 |
| JP | S30-7668 | | 10/1930 |
| JP | S32-003535 | | 6/1932 |
| JP | 1269699 | | 10/1989 |

| | | | |
|---|---|---|---|
| JP | 5192452 | | 8/1993 |
| JP | 8150818 | | 6/1996 |
| JP | 9048398 | | 2/1997 |
| JP | 9512515 | | 12/1997 |
| JP | 10076996 | | 3/1998 |
| JP | 2000-272594 | | 10/2000 |
| JP | 2003-103066 | | 4/2003 |
| JP | 2003-220999 | | 8/2003 |
| JP | 2004-121798 | | 4/2004 |
| JP | 2004121798 | A | 4/2004 |
| JP | 2005-193905 | | 7/2005 |
| JP | 2005193905 | A | 7/2005 |
| JP | 2006-051217 | | 2/2006 |
| WO | WO03/080433 | A1 | 10/2003 |
| WO | WO 2004/080556 | A2 | 9/2004 |
| WO | WO2006/075096 | | 7/2006 |

OTHER PUBLICATIONS

Photographic prior art reference #2, helicopter displaying writing in French on the tail.

Photographic prior art reference #3, explanation of the function of the flybar.

Photographic prior art reference #4, toy helicopter, www.raidentech.com.

Photographic prior art reference #5, toy helicopter.

Photographic prior art reference #6, helicopter.

Photographic prior art reference #7, helicopter with M40297 or MA0297 displayed on the tail.

Photographic prior art reference #8, toy helicopter #AHS-23900, hstoy.en.alibaba.com.

Photographic prior art reference #9, toy helicopter, toys999.en.alibaba.com.

Mill, Colin. "Practical Theories, Part 9", W3MH—World Wide Web *Model Helicopter Magazine*, Jul. 1996, http://www.w3mh.co.uk/articles/html/csm9-11.htm.

Day, David. "Moving swashplates & CCPM", 2001-2006. See http://www.iroquois.free-online.co.uk.

Selberg, B.P.; Cronin, D.L.; Rokhsaz, K.; Dykman, J.R., Yager, C. J. "Aerodynamic-Structural Analysis of Dual Bladed Helicopter Systems (Field Technical Report", Report No. NASA-CR-162754, Feb 80 46p (Abstract).

Ham, Normand. Helicopter individual-blade-control research at MIT 1977-1985; DGLR, European Rotorcraft Forum, 12th, Garmisch-Partenkirchen, West Germany; Germany, Federal Republic of; Sep. 22-25, 1986 10 pp. 1986 (Abstract).

Proctor, Paul. "Aviation Week & Space Technology", v146, n13, p. 47(1), Mar. 31, 1997 (Abstract).

Zein-Sabatto, S.; Zheng, Y. "Intelligent Flight Controllers for Helicopter Control"; 1997 IEEE International Conference on Neural Networks, Proceedings (Cat. No. 97CH36109) Part vol. 2 p. 617-21 vol. 2 (Abstract).

Mirick, Paul H. "A Comparison of Theory and Experiment for Coupled Rotor Body Stability of a Bearingless Rotor Model in Hover and Forward Flight", Jun. 1, 1988, IP Document Id 19880017770 pp. 87-101 (Abstract).

US District Court, Eastern District of Virginia, Norfolk Division, *Silverlit Toys Manufactory, Ltd*., et al., v. Westminster, Inc., et al., Case No. 2:07-cv-472-JBF/JEB.

US District Court, Northern District of Georgia, Atlanta Division, *Westminster, Inc*. v. *Silverlit Toys Manufactory, Ltd*., et al., Case No. 1:07-cv-2450-JOF.

US District Court, Central District of California, Southern Division, *Innovage LLC* v. *Silverlit Toys Manufactory*, Ltd., et al., Case No. SACV07-1334 DOC (ANx).

"Declaration of Alexander Van De Rostyne in Support of Defendants and Counterclaimants Silverlit Toys Manufactory Ltd.'s and Spin Master Ltd.'s Motion for Preliminary Injunction", with relevant Exhibits A, C and E-Q, filed on Dec. 3, 2007, in USDC Case No. SACV07-1334 Doc (ANx).

"Declaration of Kei Fung ("Kevin") Choi in Support of Defendants and Counterclaimants' Motion for Preliminary Injunction", with relevant Exhibits A, C, and E, filed on Dec. 3, 2007, in USDC Case No. SACV07-1334 Doc (ANx).

"Declaration of L. Kenneth Rosenthal in Support of Counterclaimants Silverlit Toys Manufactory Ltd.'s and Spin Master Ltd.'s Motion for Preliminary Injunction", with relevant Exhibits O, P, S, V, Y, BB, MM and NN, filed on Dec. 3, 2007, in USDC Case No. SACV07-1334 Doc (ANx).

"Memorandum of Points and Authorities in Support of Motion for Preliminary Injunction of Silverlit Manufactory Ltd. and Spin Master Ltd.", filed on Dec. 3, 2007, in USDC Case No. SACV07-1334 Doc (ANx).

"Declaration of Valerie W. Ho in Support of Defendants and Counterclaimants' Motion for Preliminary Injunction", with relevant Exhibits a, B and M, filed on Dec. 3, 2007, in Usdc Case No. SACV07-1334 Doc (ANx).

"Declaration of Conor Forkan in Support of Counterclaimants Silverlit Toys Manufactory Ltd.'s and Spin Master Ltd.'s Reply to Innovage's Opposition to Motion for Preliminary Injunction", with relevant Exhibits A-D, filed on Dec. 26, 2007, in Usdc Case No. SACV07-1334 Doc (ANx).

"Declaration of L. Kenneth Rosenthal in Support of Counterclaimants Silverlit Toys Manufactory Ltd.'s and Spin Master Ltd.'s Reply to Innovage's Opposition to Motion for Preliminary Injunction", with relevant Exhibits A-D, filed on Dec. 26, 2007, in Usdc Case No. SACV07-1334 Doc (ANx).

"Counterclaimants Silverlit Toys Manufactory Ltd.'s and Spin Master Ltd.'s Reply in Support of Motion for Preliminary Injunction", filed on Dec. 26, 2007, in USDC Case No. SACV07-1334 Doc (ANx).

"Innovage's Memorandum of Points and Authorities in Opposition to Silverlit and Spin Master's Motion for Preliminary Injunction", filed on Dec. 19, 2007, in USDC Case No. SACV07-1334 DOC (ANx).

"Declaration of Francisco Rubio-Campos in Support of Plaintiff Innovage LLC's Opposition to Silverlit and Spin Master's Motion for Preliminary Injunction", filed on Dec. 19, 2007, in USDC Case No. SACV07-1334 Doc (ANx).

"Declaration of Jennifer Hamilton in Support of Plaintiff Innovage LLC's Opposition to Silverlit and Spin Master's Motion for Preliminary Injunction", filed on Dec. 19, 2007, in USDC Case No. SACV07-1334 DOC (ANx).

"Counterclaim Defendant Merchsource's Opposition to Preliminary Injunction", filed on Dec. 19, 2007, in USDC Case No. SACV07-1334 DOC (ANx).

"Declaration of Lowell Anderson in Opposition to Preliminary Injunction", filed on Dec. 19, 2007, in USDC Case No. SACV07-1334 DOC (ANx).

"Supplemental Declaration of Francisco Rubio-Campos in Support of Plaintiff Innovage LLC's Opposition to Silverlit and Spin Master's Motion for Preliminary Injunction", filed on Jan. 4, 2008, in USDC Case No. SACV07-1334 DOC (ANx).

"Declaration of Nicholas Ringold in Support of Defendants and Counterclaimants' Reply to Merchsource Llc's Opposition to Ex Parte Application to Shorten Time for Hearing on Preliminary Injunction", with relevant Exhibits B-I, filed on. Dec. 5, 2007, in Usdc Case No. SACV07- 1334 Doc (ANx).

"Declaration of Kei Fung ("Kevin") Choi in Support of Defendants and Counterclaimants' Reply to Merchsource Llc's Opposition to Ex Parte Application to Shorten Time for Hearing on Preliminary Injunction", with Exhibit a, filed on Dec. 6, 2007, in Usdc Case No. SACV07-1334 Doc (ANx).

"Counterclaimants Silverlit Toys Manufactory Ltd.'s and Spin Master's Reply to Merchsource LLC's Opposition to Ex Parte Application to Shorten Time on Hearing on Motion for Preliminary Injunction", filed on Dec. 6, 2007, in USDC Case No. SACV07-1334 DOC (ANx).

"Counterclaimants Silverlit Toys Manufactory Ltd.'s and Spin Master's 1) Reply to Innovage LLC's Opposition to Ex Parte Application to Shorten Time on Hearing on Motion for Preliminary Injunction, and 2) Opposition to Innovage LLC's Ex Parte Application for Order to Extend Time to Oppose Motion for Preliminary Injunction", filed on Dec. 5, 2007, in USDC Case No. SACV07-1334 DOC (ANx).

"Declaration of Lowell Anderson in Opposition to Ex Parte Application to Shorten Time for Hearing on Preliminary Injunction", filed on Dec. 4, 2007, in Usdc Case No. SACV07-1334 DOC (ANx).
"Counterclaim Defendant Merchsource's Opposition to Ex Parte Application to Shorten Time for Hearing on Motion for Preliminary Injunction", filed on Dec. 4, 2007, in USDC Case No. SACV07-1334 DOC (ANx).
"Plaintiff Innovage LLC's Opposition to Defendant Silverlit and Spin Master's Ex Parte Application for Order to Shorten Time for Hearing on Defendants' Motion for Preliminary Injunction; Declaration of Barry Messner in Support", filed on Dec. 4, 2007, in USDC Case No. SACV07-1334 DOC (ANx).
"Plaintiff Innovage LLC's Ex Parte Application for Order to Extend Time to Oppose Defendants' Motion for Preliminary Injunction; Memorandum of Points and Authorities; Declaration of Barry Messner", filed on Dec. 4, 2007, in USDC Case No. SACV07-1334 DOC (ANx).
"Amended Answer, Affirmative Defenses and Counterclaims for: (1) Patent Infringement; (2) Trade Dress Infringement; (3) Unfair Competition and False Designation of Origin; (4) Unfair Competition Under California Business & Professions Code § 17200; and (5) Copyright Infringement", filed on Dec. 11, 2007, in USDC Case No. SACV07-1334 DOC (ANx).
"Innovage's Reply in Opposition of Silverlit and Spin Master to Plaintiff Innovage LLC's Ex Parte Application for Order to Extend Time to Oppose Defendants' Motion for Preliminary Injunction", filed on Dec. 7, 2007, in USDC Case No. SACV07-1334 DOC (ANx).
"Counterclaim Defendant Innovage LLC's Amended Reply and Affirmative Defenses to Counterclaims of Silverlit Toys Manufactory Ltd. and Spin Master Ltd.", filed on Jan. 9, 2008, in USDC Case No. SACV07-1334 DOC (ANx).
"Order Denying Defendants' Motion for Preliminary Injunction", filed on Jan. 8, 2008, in USDC Case No. SACV07-1334 DOC (ANx).
"Counterclaimants Silverlit Toys Manufactory Ltd.'s and Spin Master's Ltd.'s Objection and Motion to Strike Plaintiff Innovage LLC's Belated Supplemental Declaration of Francisco Rubio-Campos", filed on Jan. 4, 2008, in USDC Case No. SACV07-1334 DOC (ANx).
"Supplemental Declaration of Francisco Rubio-Campos in Support of Plaintiff Innovage LLC's Opposition to Silverlit ad Spin Master's Motion for Preliminary Injunction", filed on Jan. 4, 2008, in USDC Case No. SACV07-1334 DOC (ANx).
"Counterclaim Defendant Innovage LLC's Reply and Affirmative Defenses to Counterclaims of Silverlit Toys Manufactory Ltd. and Spin Master Ltd.", filed on Dec. 26, 2007, in USDC Case No. SACV07-1334 DOC (ANx).
"Counterclaim Defendant Merchsource LLC's Answer and Defenses to Counterclaims of Silverlit Toys Manufactory Ltd. and Spin Master Ltd.", filed on Dec. 26, 2007, in USDC Case No. SACV07-1334 DOC (ANx).
"Answer, Affirmative Defenses and Counterclaims for: (1) Patent Infringement; (2) Trade Dress Infringement; (3) Unfair Competition and False Designation of Origin; and (4) Unfair Competition Under California Business & Professions Code § 17200", with Exhibits E & F, filed on Dec. 3, 2007, in USDC Case No. SACV07-1334 DOC (ANx).
"Complaint for: 1) Declaratory Judgment of Invalidity and Non-Infringement of Certain Design Patents; 2) Declaratory Judgment of Invalidity and Non-Infringement of Trade Dress", filed on Nov. 13, 2007, in USDC Case No. SACV07-1334 DOC (ANx).
Photo of portion of PicooZ product package; Silverlit 2006 Product Catalog (5 pages total).
Partial International Search from PCT/US2006/047982.
Photographic prior art reference, Dragonfly helicopter (2005) (4 pages).
*Piccolino: 1.69 gram RC helicopter*—RCGroups.com, http://www.rcgroups.com/forums/showthread.php?t=509295, Apr. 24, 2006 (6 pages).
International Search from PCT/US2008/051938.
Pryun, Richard R. "In-flight measurement of rotor blade airloads, bending moments, and motions, together with rotor shaft loads and fuselage vibration, on a tandem rotor helicopter", *Boeing*, Nov. 1967 (Abstract, 1 pg).
Brahmananda, et al. "Application of passive dampers to modern 1996 http://www.iop.orq/EJ/abstract/0964-1726/5/5/001 (Abstract, helicopters", Smart Mater, 1 pg).
http://www.microhelicopters.net, Jul. 7, 2008 (3 pgs).
Castillo, et al. "Real-time stabilization and tracking of a four-rotor mini rotorcraft", IEEE, Jul. 2004 http://www.ieeexplore.org/xpl/freeabs_all.isp?arnumber=1308180 (1 pg).
"Structural Components, Design of Tilt-Rotor Jvx Near Completion", Aviation Week & Space Technology, Vol. 122, No. 2, pg. 84, Jan. 14, 1985 (10 pgs).
European Search Opinion dated Jun. 10, 2008, in EP 06 845 583.1.
Website reference, en.wikipedia.org/wiki/Kamov_Ka-50, Kamov Ka-50, Jun. 19, 2004 (6 pages).
Photographic reference, en.wikipedia.org/wiki/Image:Kamov_Ka-50_MAKS-2005.jpg, Aug. 28, 1995.
Photographic reference, www.fas.orq/man/dod-101/sys/ac/row/ka-50-hokum.ipg, Aug. 28, 1995.
Photographic reference, vvww.aviastar.org/foto/ka-50_1.jpg, Aug. 28, 1995.
Website reference, web.archive.org/web/20050225044931/http://www.silverlit.com (2 pages), Jun. 5, 2007.
Website reference, web.archive.org/web/20060616140712/boeing.corn/rotorcraft/military/ah64d/index.htm, Nov. 23, 2001 (2 pages)
Website reference, en.wikipedia.orq/wiki/AH-646_Apache, Jul. 16, 2004 (11 pages).
Website reference, http://www.globalsecurity.orq/military/systems/aircraft/ah-64d.htm, Nov. 7, 2001 (6 pages).
Photographic reference, www.fas.org/man/dod-101/sys/ac/ah-64.gif,Aug. 19, 2000.
Photographic reference, en.wikipedia.org/wiki/Image:P320007.jpg, 1981 (3 pages).
Photographic reference, www.fas.org./man/dod-101/sys/ac/ah-64d 001.jpg, Mar. 21, 1997.
Photographic reference, www.fas.org./man/dod-101/sys/ac/ah-64d-imaqe83.jpg, Aug. 19, 2000.
Photographic reference, www.fas.org./man/dod-101/sys/ac/ah-64d-longbow1.jpq, Aug. 19, 2000.
Photographic reference, www.fas.org/man/dod-101/sys/ac/ah-64-dvic2941pg, Feb. 2, 2003.
Photographic reference, www.voodoo.cz/ah64/pics/ah115.jpg, Jun. 14, 2001.
Photographic reference, www.voodoo.cz/ah64/pics/ah122.jpg, Jan. 10, 2002.
Photographic reference, wwvv.voodoo.cz/ah64/pics/ah106.jpg, Jan. 9, 2002.
Photographic reference, www.voodoo.cz/ah64/picstah112.jpg, Aug. 22, 2002.
Photographic reference, www.voodoo.cz/ah64/pics/ah092.jpg, Jan. 8, 2002.
Photographic reference, www.voodoo.cz/ah64/pics/ah153.jpg, Apr. 4, 2002.
Photographic reference, www.voodoo.cz/ah64/pics/ah149.jpg, Jul. 8, 2000.
Photographic reference, www.voodoo.cz/ah64/pics/ah051.jpg, Jan. 8, 2002.
Photographic reference, www.voodoo.cz/ah64/pics/ah049.jpg, Mar. 15, 2002.
Photographic reference, www.voodoo.cz/ah64/pics/ah027.jpg, May 8, 1999.
Photographic reference, www.voodoo.cztah64/bics/ah010.jpg, Jul. 8, 2000.
Photographic reference, www.voodoo.cz/ah64/pics/ah003.jpg, Sep. 1, 2001.
Photographic reference, www.airforceworld.com/heli/gfx/ah64/wah64_1.jpg, 1991.
Photographic reference, www.fas.org/man/dod-101/sys/ac/ah-64a-990421-F-2095R-004.jpg, Aug. 19, 2000.
Photographic reference, www.fas.org/man/dod-101/sys/ac/ah-64-dvic292.jpg, Aug. 19, 2000.
Website reference, www.runryder.com/helicopter/t285494p1/, Jun. 12, 2007 (10 pages).
Website reference, web.archive.org/web/20031218200732/http://www.scarlet.be/pixel/pixeli111.htm, Dec. 18, 2003 (7 pages).

Website reference, web.archive.orq/web/20031017234927/http://www.scarlet.be/pixel/pixelfp.htm, Oct. 17, 2003 (2 pages).
Website reference, web.archive.org/web/20031218061901/http://pixelito.reference.be/, Dec. 18, 2003 (4 pages).
Website reference, www.aviastar.org/helicopters_eng/brequet-dorand.php, 1935 (4 pages).
Website reference, www.lionheartcreations.conn/Lionheartsfliqhtsimsite paqe7.html, May 6, 2004 (4 pages).
Website reference, www.lionheartcreations.com/FalconE.html, Jun. 22, 2004 (2 pages).
Photographic reference, wvvw.rotaryaction.com/images/airwolf4.jpg, 1984.
Website reference, www.rotaryaction.com/pages/airwolf.html, 1984 (3 pages).
Website reference, http://wvvw.youtube.com/watch?v=DsXqmOurwts, "Golden Age Pioneers—Nicolas Florine", Mar. 28, 2008 (4 pages).
Robert Dingemanse, Press Release "Flying Car Company Takes Off", Mar. 2007, http://www.pal-v.com.
"Esky Dauphin 4-channels Mini Electric Coaxial Helicopter", http://www.esky-heli.com/esky-24g-4ch-dauphin-bluegrev-rtf-kit-for-beginner-flicihtsim-p-2994.html, May 8, 2008.
Chinook Helicopter, first flight 1961, as referenced in Wikipedia http://en.wikipedia.orq/wiki/Ch-47_Chinook, Dec. 15, 2008 (11 pages).
Office Action dated Feb. 10, 2009, from U.S. Appl. No. 11/462,177 (pending) (9 pages).
Office Action dated Feb. 10, 2009, from U.S. Appl. No. 11/465,781 (pending) (9 pages).
Office Action dated May 8, 2008, from U.S. Appl. No. 11/754,752, now 7,494,397 (9 pages).
Office Action dated May 7, 2008, from U.S. Appl. No. 11/842,719, now 7,467,984 (9 pages).
Office Action dated May 8, 2008, from U.S. Appl. No. 11/953,826, now 7,425,167 (10 pages).
Office Action dated May 8, 2008, from U.S. Appl. No. 11/953,830, now 7,425,168 (10 pages).
Office Action dated May 8, 2008, from U.S. Appl. No. 11/953,823, now 7,422,505 (11 pages).
Office Action dated Mar. 31, 2009, from U.S. Appl. No. 12/264,890 (pending) (8 pages).
Office Action dated May 29, 2009, from U.S. Appl. No. 12/264,890 (pending) (10 pages).
Office Action dated Jun. 1, 2009, from U.S. Appl. No. 11/627,919 (pending) (9 pages).
Office Action dated Jun. 2, 2009, from U.S. Appl. No. 11/736,506 (pending) (9 pages).
Office Action dated Jun. 16, 2009, from U.S. Appl. No. 12/402,446 (pending) (10 pages).
DAVIS: Vectron Ultralite Battery Operated Radio/Infrared Controlled Flying Saucer Toy; U.S. Copyright Registration No. VA 1-285-847.
Rotory Modeler Magazine; Mar./Apr. 2005 issue; 62 pages; Moneta, VA US; www.rotory.com.
Rotory Modeler Magazine; Jan./Feb. 2005 issue; 2 pages; Moneta, Va US; www.rotory.com.
Hirobo Indoor Flight Helicopter, X.R.B SRlama Sky Robo; product manuel; Jul. 2004; 37 pages; http://model.hirobo.co.jp/; (Japanese text).
Hirobo Indoor Flight Helicopter, X.R.B SRlama Sky Robo; product manuel; Jul. 2004; 37 pages; http://model.hirobo.co.jp/; (English translation).
Rotory Modeler Magazine; Mar./Apr. 2005 issue; 12 pages; Moneta, VA US; www.rotory.com.
Rotoryworld Magazine; Issue Seven; Dec./Jan. 2005 issue; 4 pages; Bedfordshire UK.
FLYRC Magazine; Mar. 2005 issue; 6 pages; US.
Model Helicopter World Magazine; Mar. 2005 issue; 7 pages; UK.
Rotory Modeler Magazine; Jan./Feb. 2005 issue; 2 pages; Moneta, VA US; www.rotory.com.
Parts List; Hirobo S.R.B Price List; Jul./Jan./Oct. 2004; 4 pages; Edison, NJ US.
Cambridge Aerospace Series, Principles of Helicopter Aerodynamics; 2000; 5 pages; New York, NY US; www.cambridge.org/9780521660600.

* cited by examiner

1
F5
6
16
108
12
3
39
31
37
15
28
8
102
35
F2
5
36
28
31
33-34
106
104
39
32
100
4
7
2
12
RADIO CONTROL UNIT

TOY HELICOPTER

BACKGROUND

The present disclosure concerns an improved toy helicopter.

The disclosure concerns a helicopter generally. In particular, it is related to a toy helicopter and in particular to a remote-controlled model helicopter or a toy helicopter.

It is known that a helicopter is a complex machine which is unstable and as a result difficult to control, so that much experience is required to safely operate such helicopters without mishaps. Also the mass manufacture of toy helicopter with predetermined flying characteristics is relatively difficult. This is because of the sensitivity of the different parts when mass manufactured and the need for precision in assembling the different small components of the toy helicopter. Slight imperfections or differences can cause significant differences in flying attributes. There is a need to provide for adjustment after assembly and also for adjustment by a user.

SUMMARY

A toy helicopter, in accordance with the present disclosure, includes a body having a longitudinal length and a main rotor. There is an element movable along the longitudinal length. The element allows a user to selectively adjust the location of the center of gravity of a toy helicopter by moving the element along the longitudinal length, thereby changing the velocity of the helicopter.

DRAWINGS

In order to further explain the characteristics of the disclosure, the following embodiments of an improved helicopter according to the disclosure are given as an example only, without being limitative in any way, with reference to the accompanying drawings, in which:

FIG. 1 schematically represents a helicopter according to the disclosure in perspective;

Figure 11:
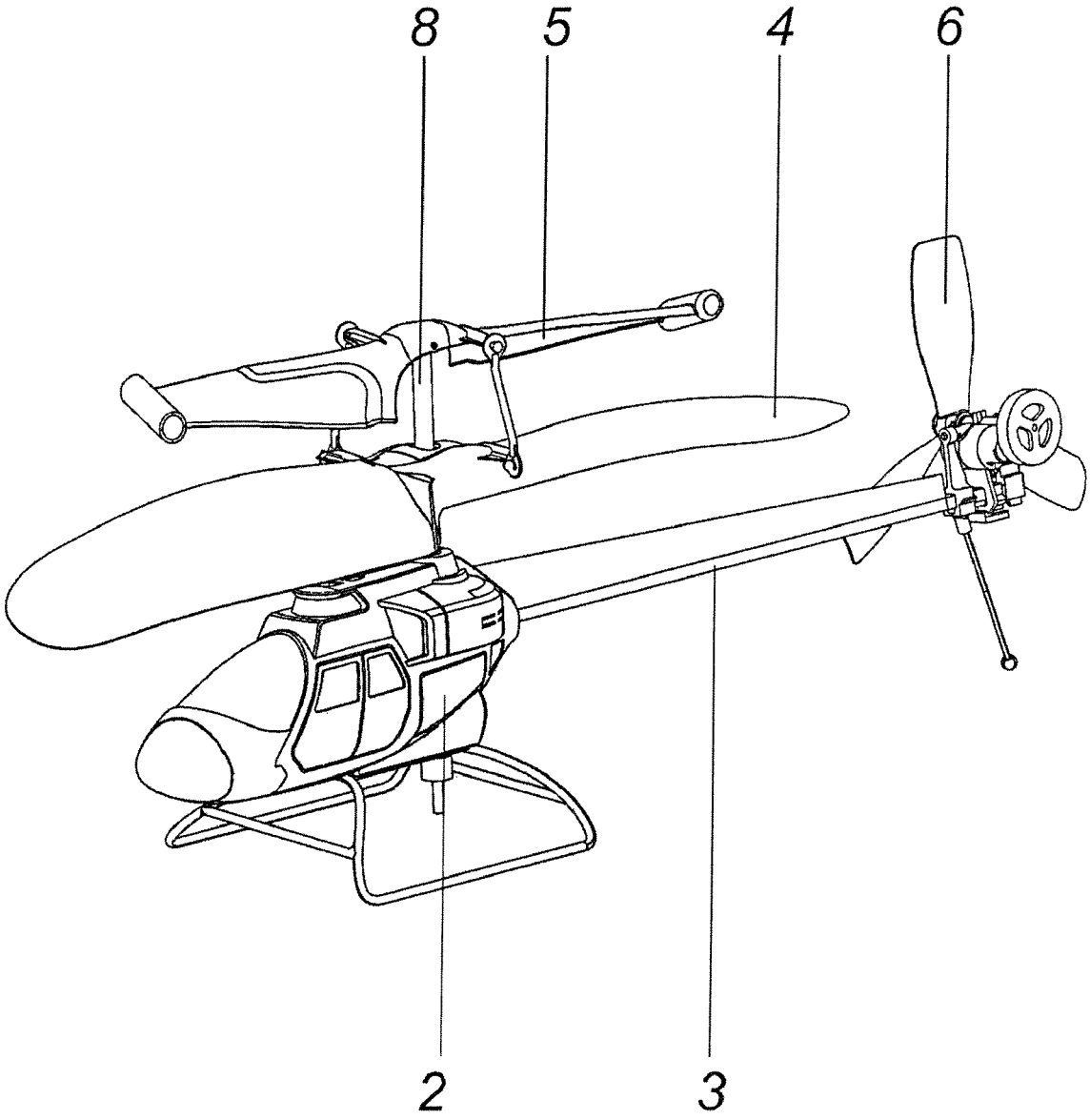
Figure 12:
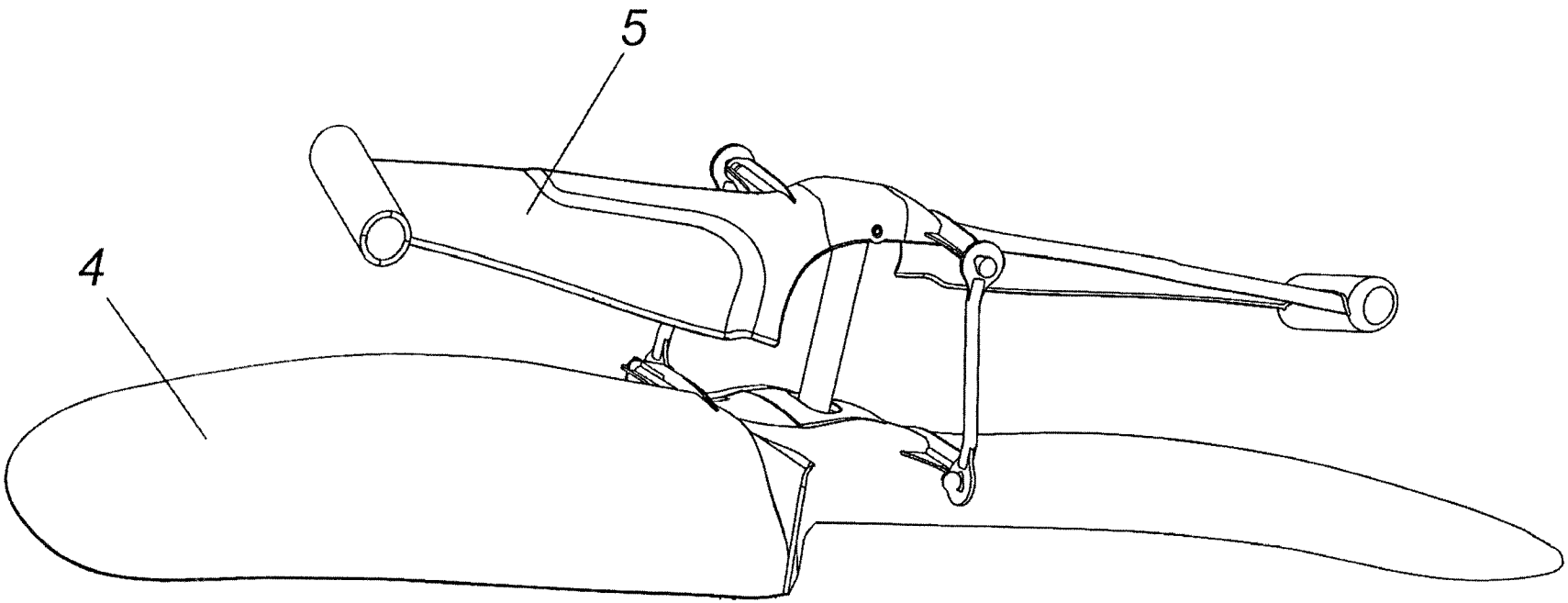
Figure 13:
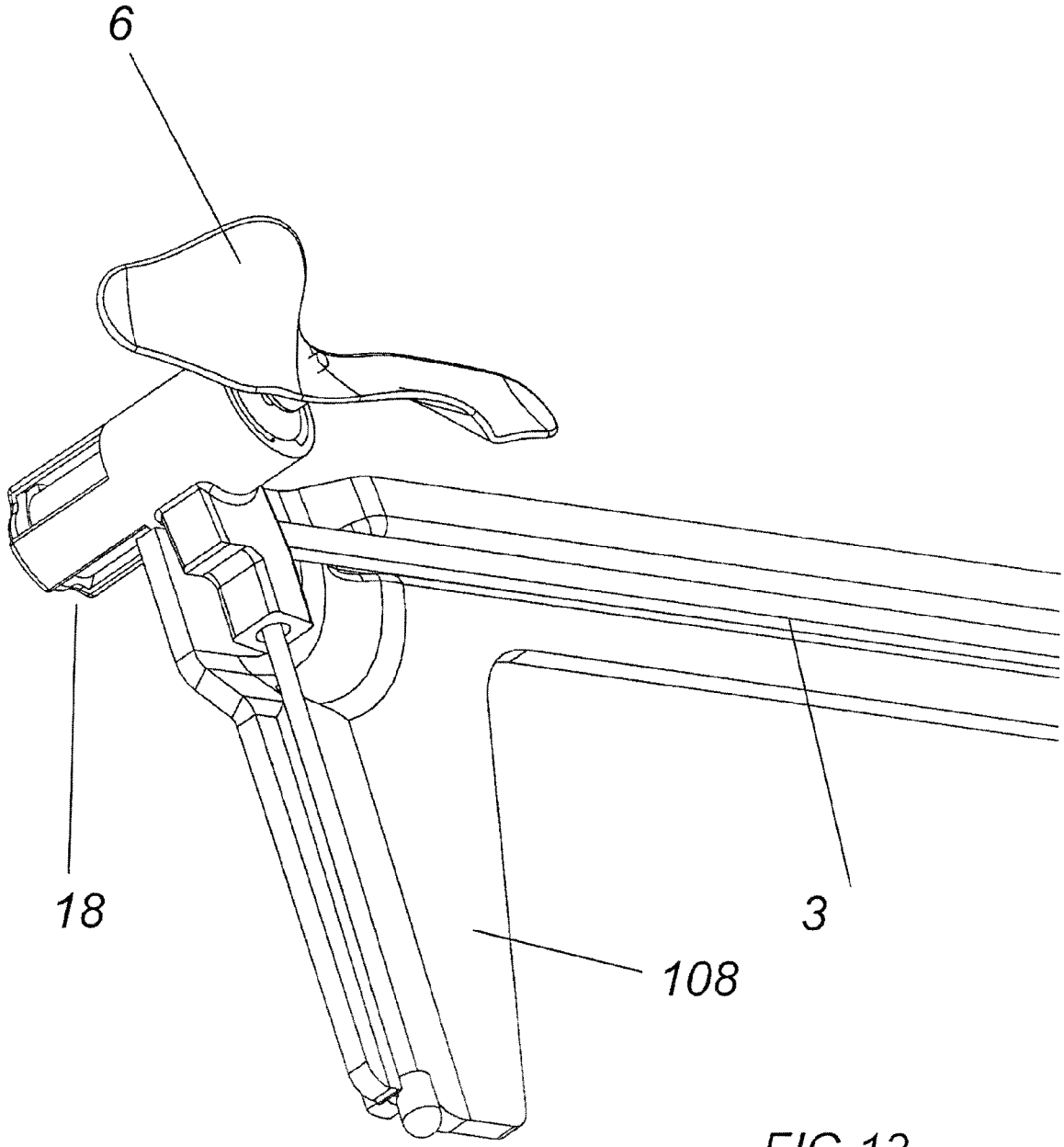
Figure 14:
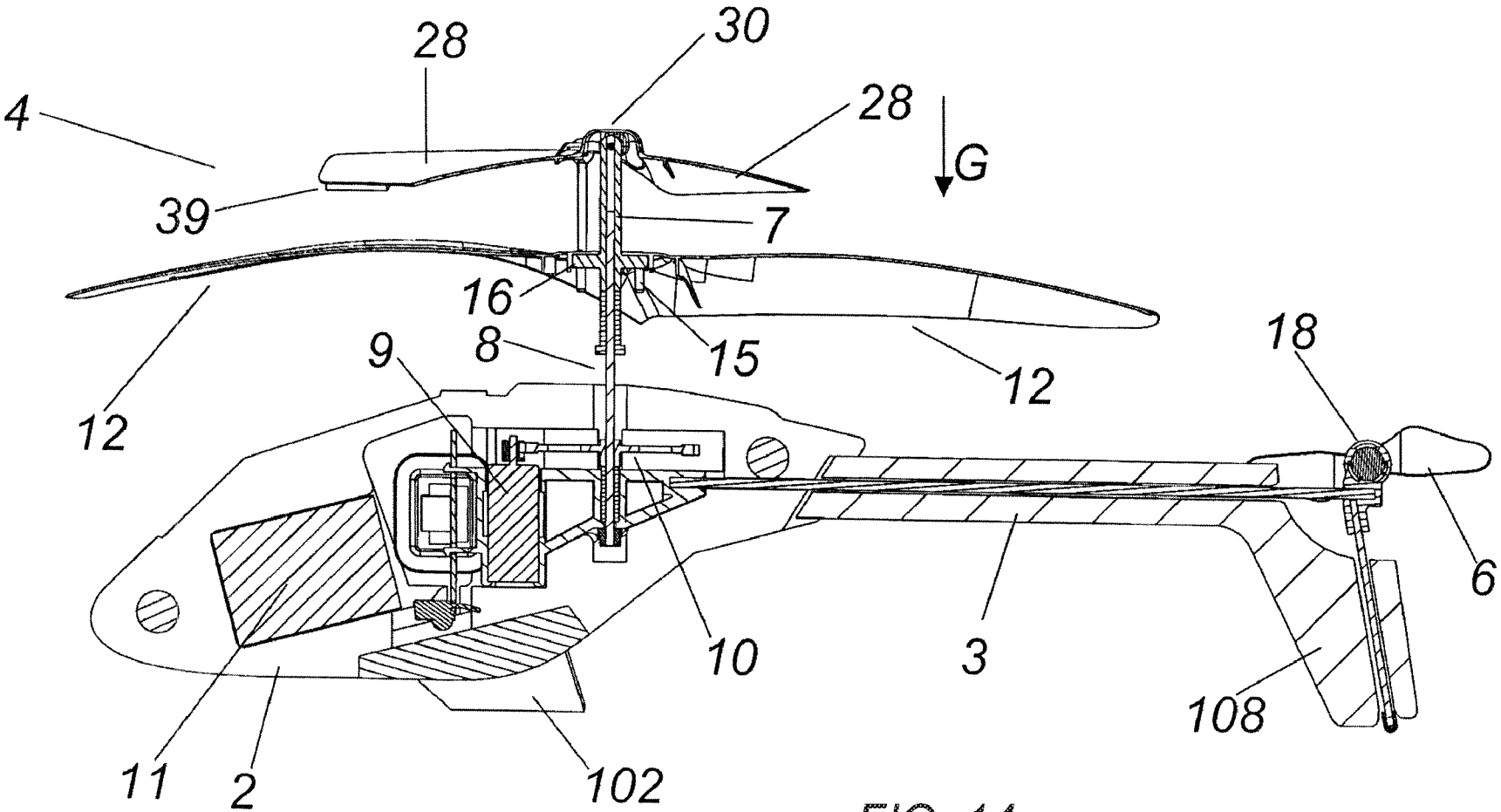
Figure 15:
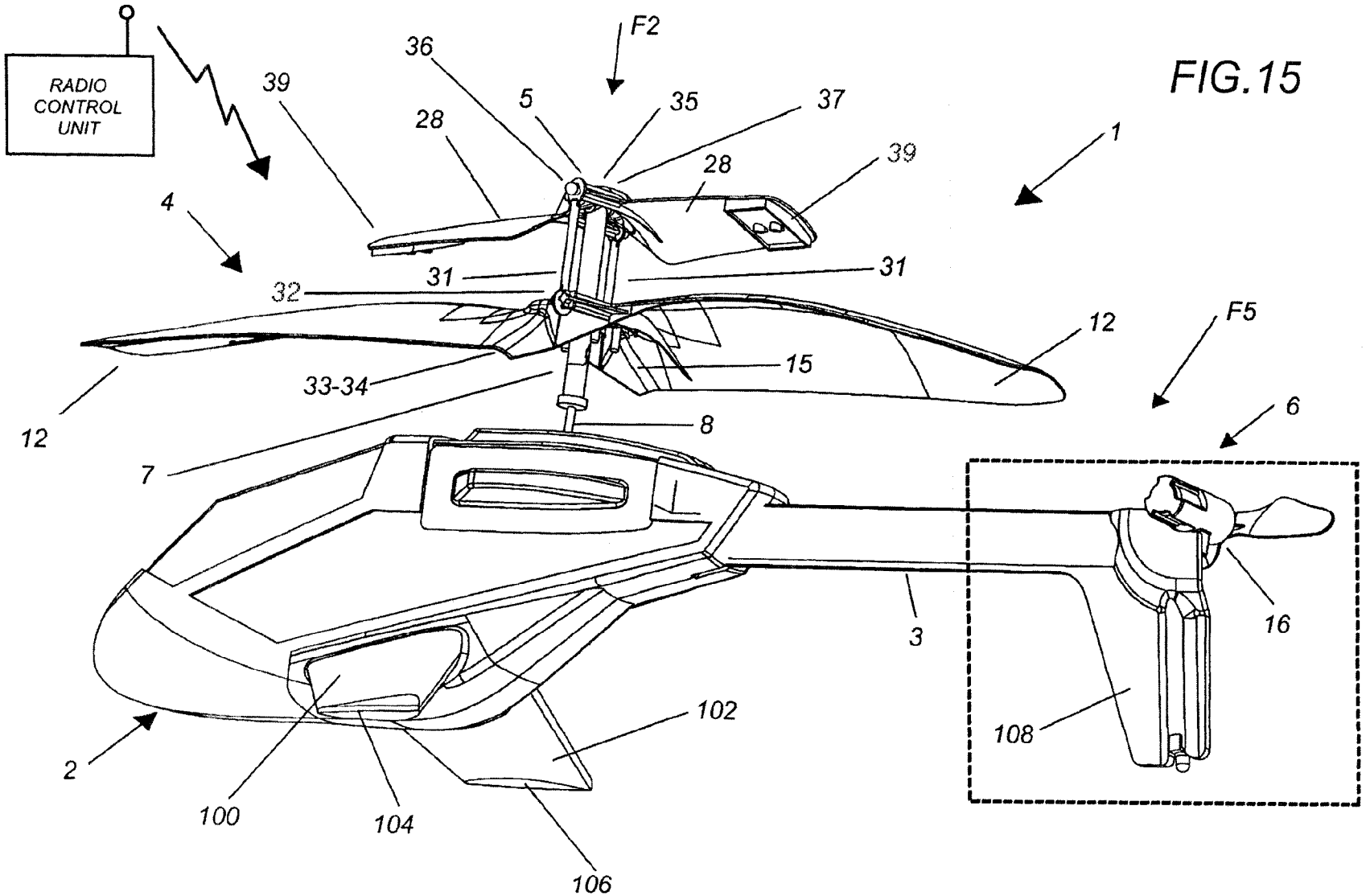
Figure 16:
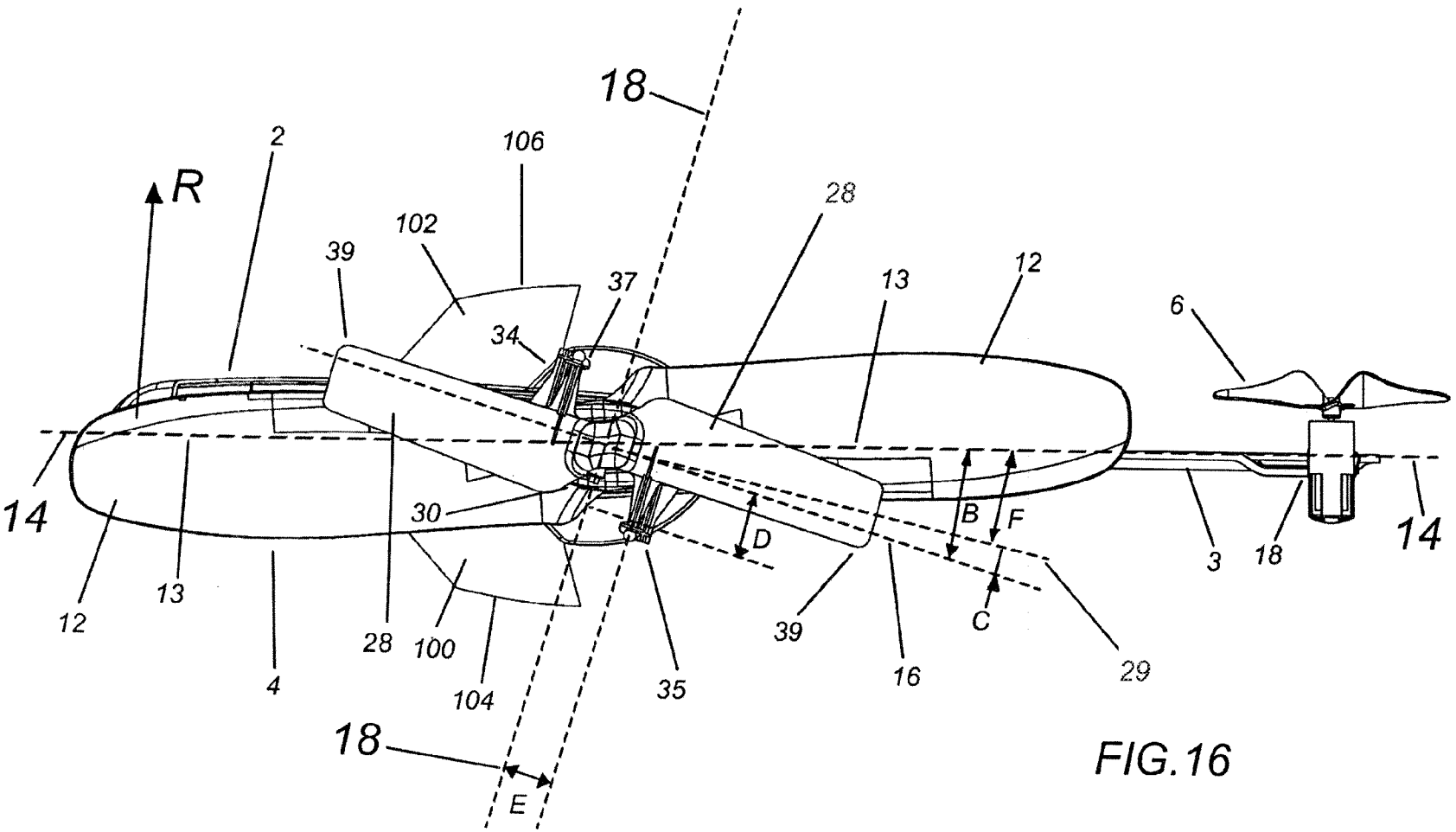
Figure 17:
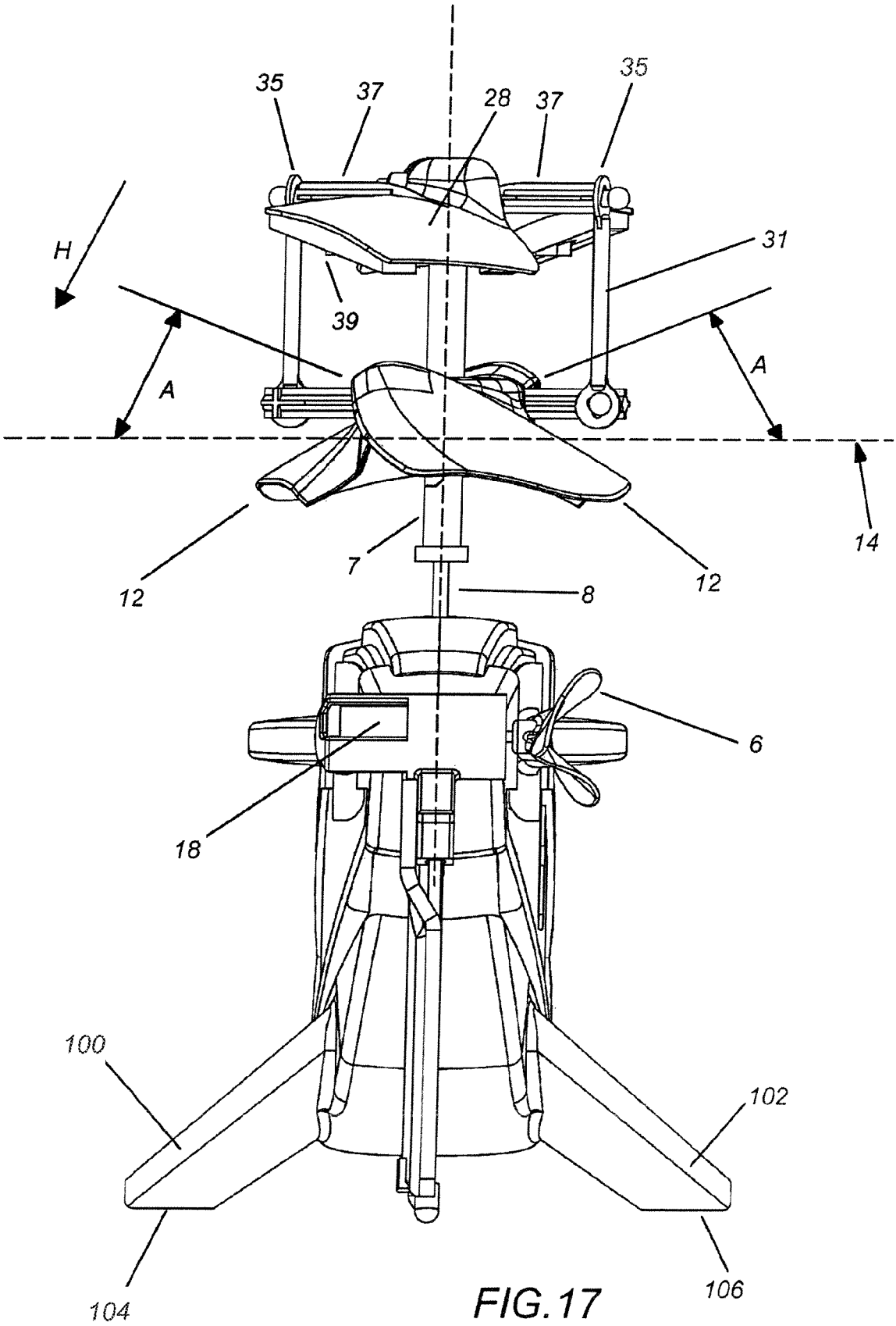
Figure 18:
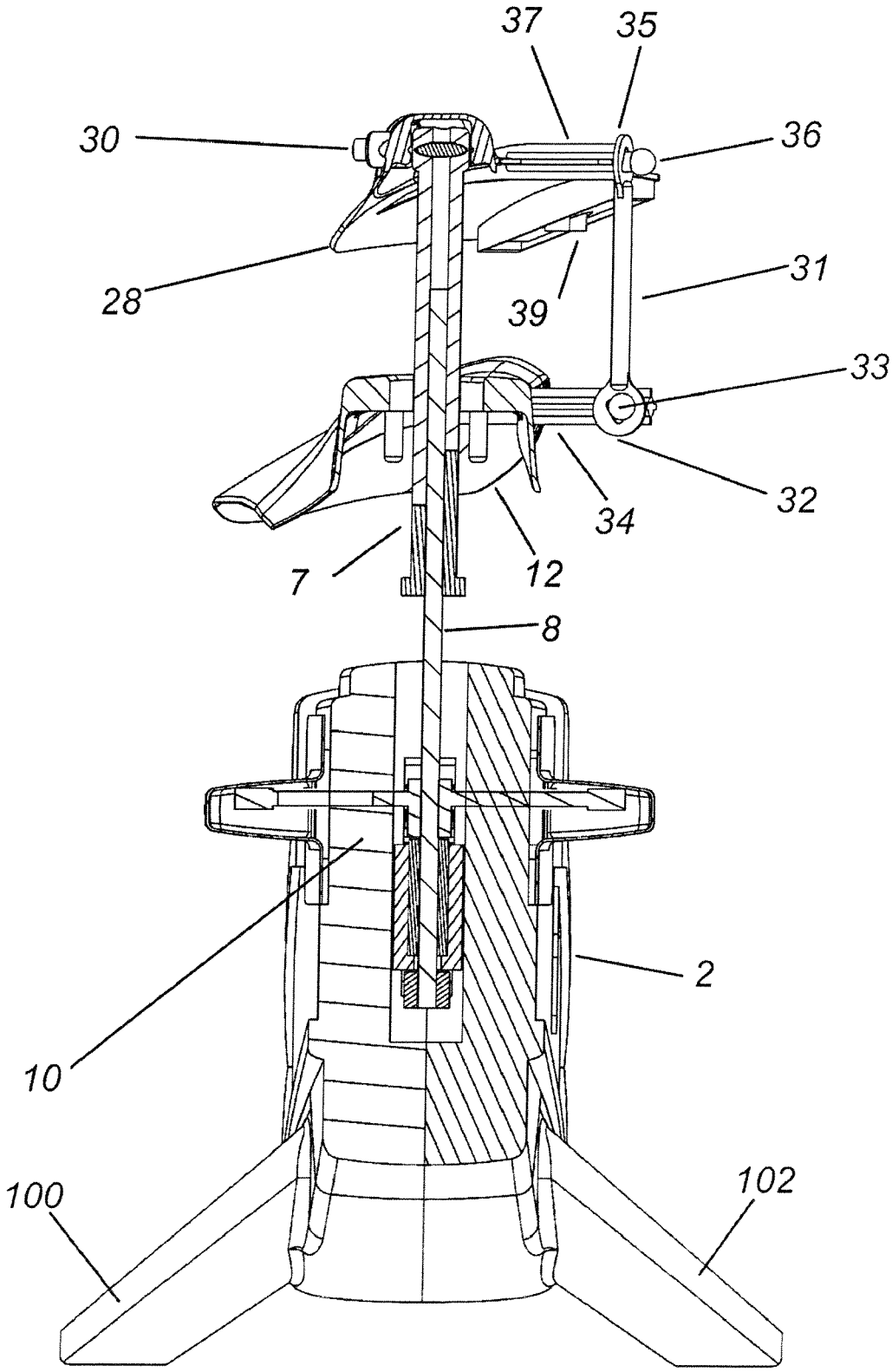

FIG. 11 schematically represents an alternative view of the helicopter according to the disclosure in perspective;

FIG. 12 is a perspective view of the main rotor and auxiliary rotor;

FIG. 13 is a perspective view of the tail rotor and tail stabilizer in an embodiment of the helicopter;

FIG. 14 represents a side sectional view in an embodiment of the helicopter;

FIG. 15 represent a perspective view of an embodiment of the helicopter;

FIG. 16 represents a top view of an embodiment of the helicopter;

FIG. 17 is a rear view of an embodiment of the helicopter;

FIG. 18 represents a sectional view of an embodiment of the helicopter along line 18-18 of FIG. 16.

Figures 19A, 19B:
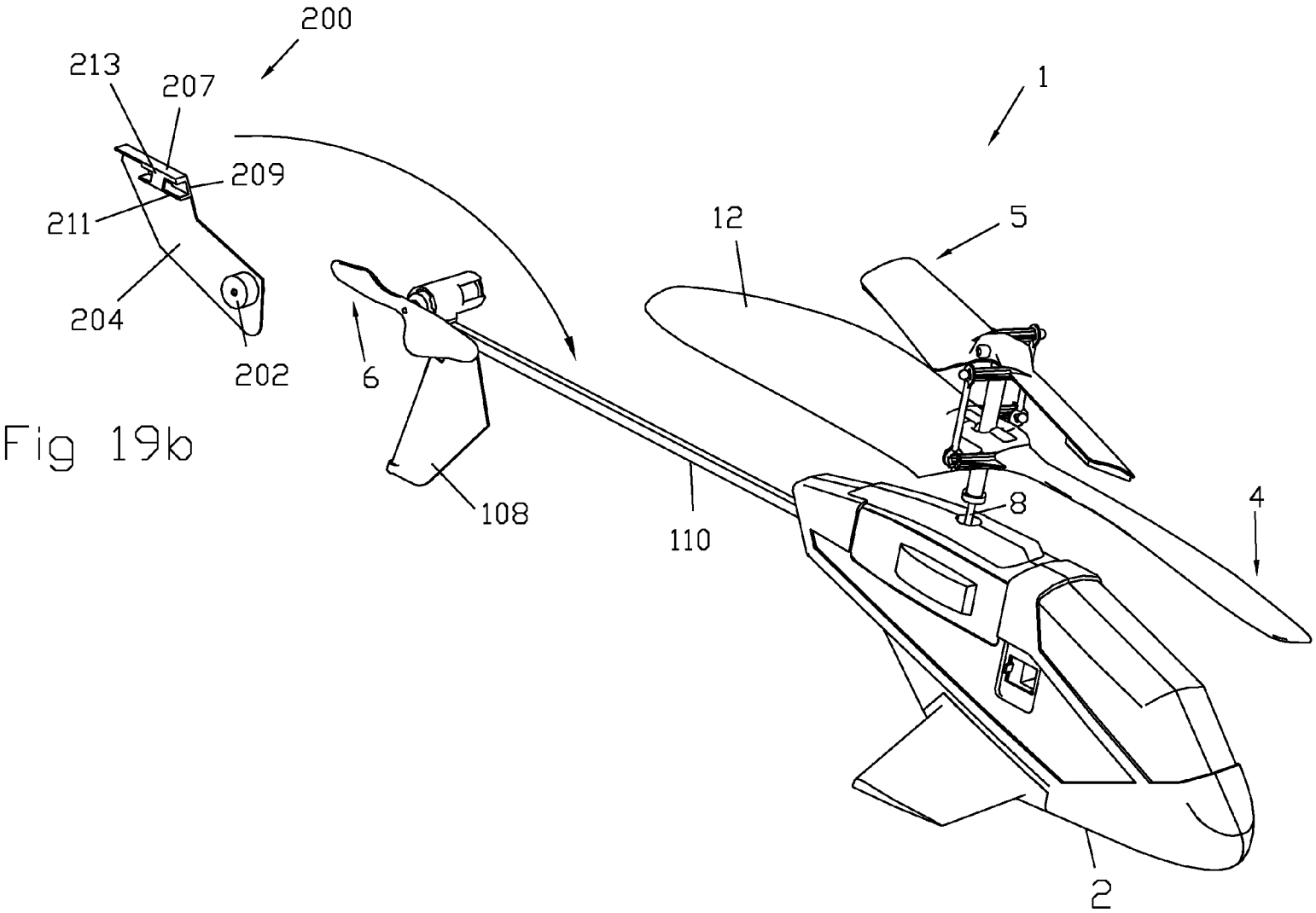
Figure 20B:
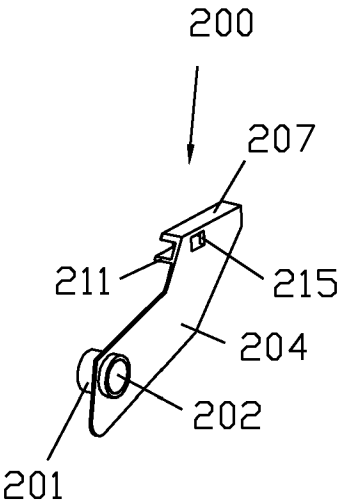
Figure 20A:
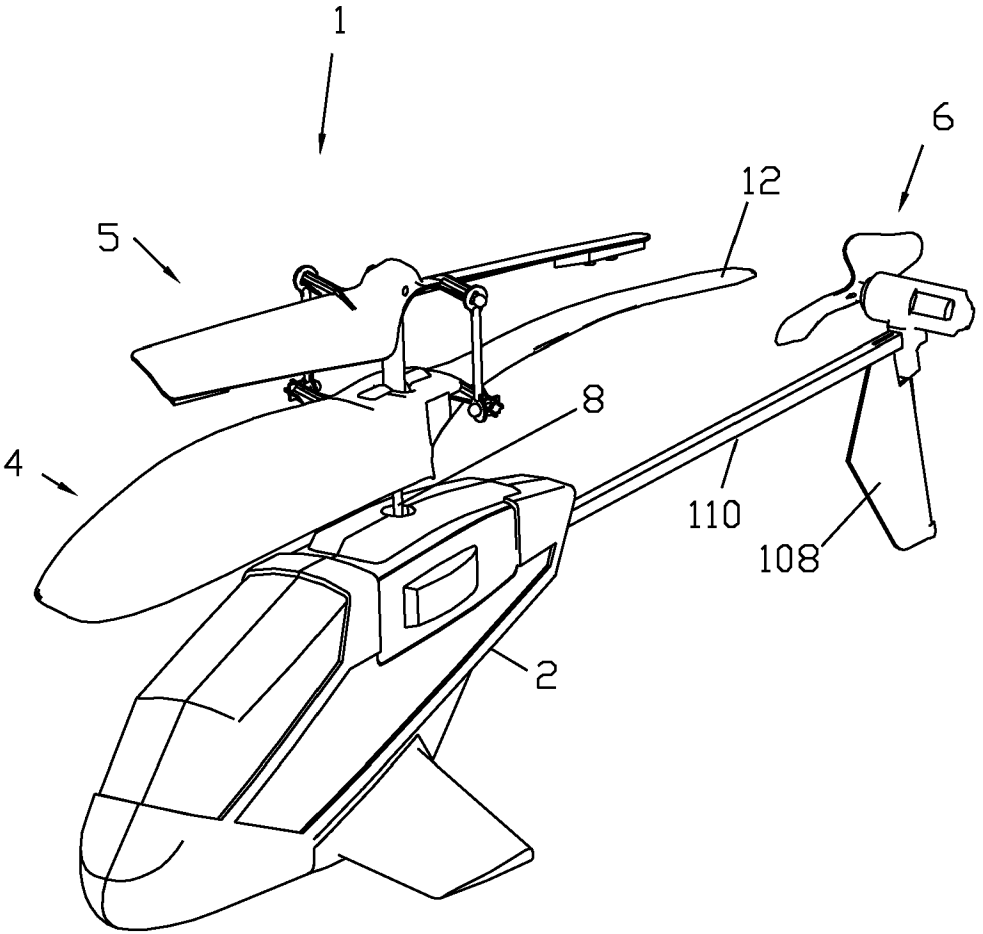
Figure 21:
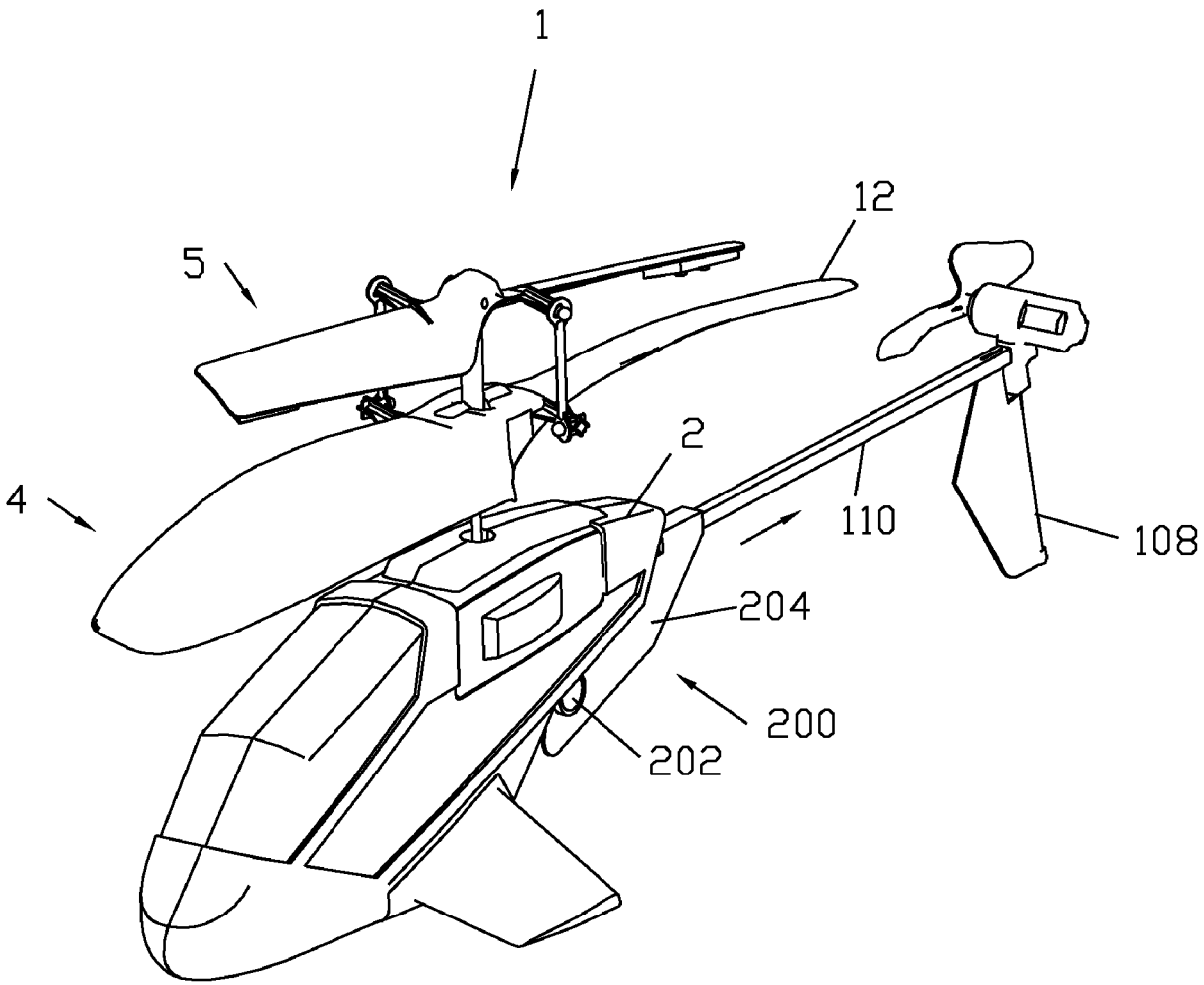
Figure 22:
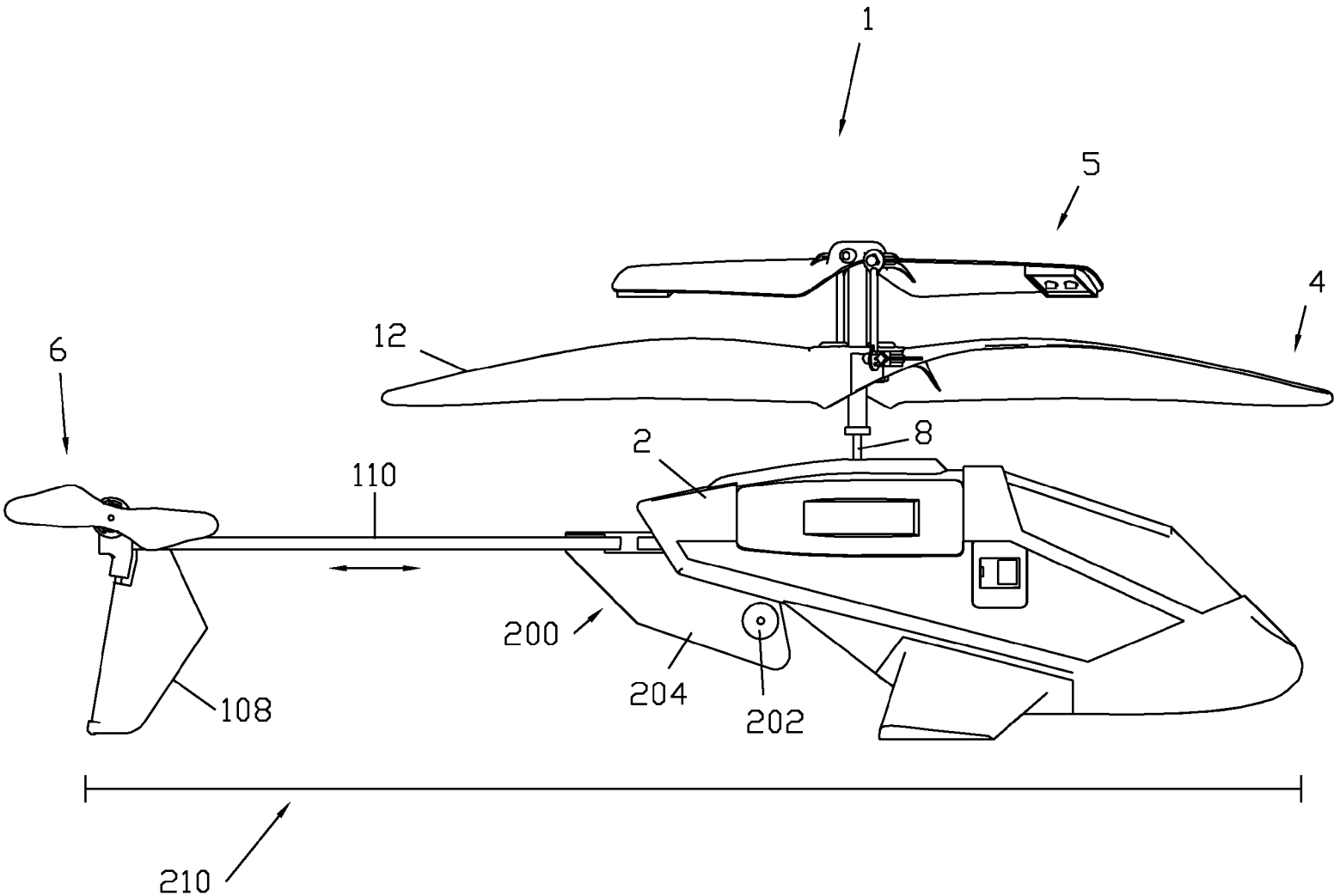
Figure 23:
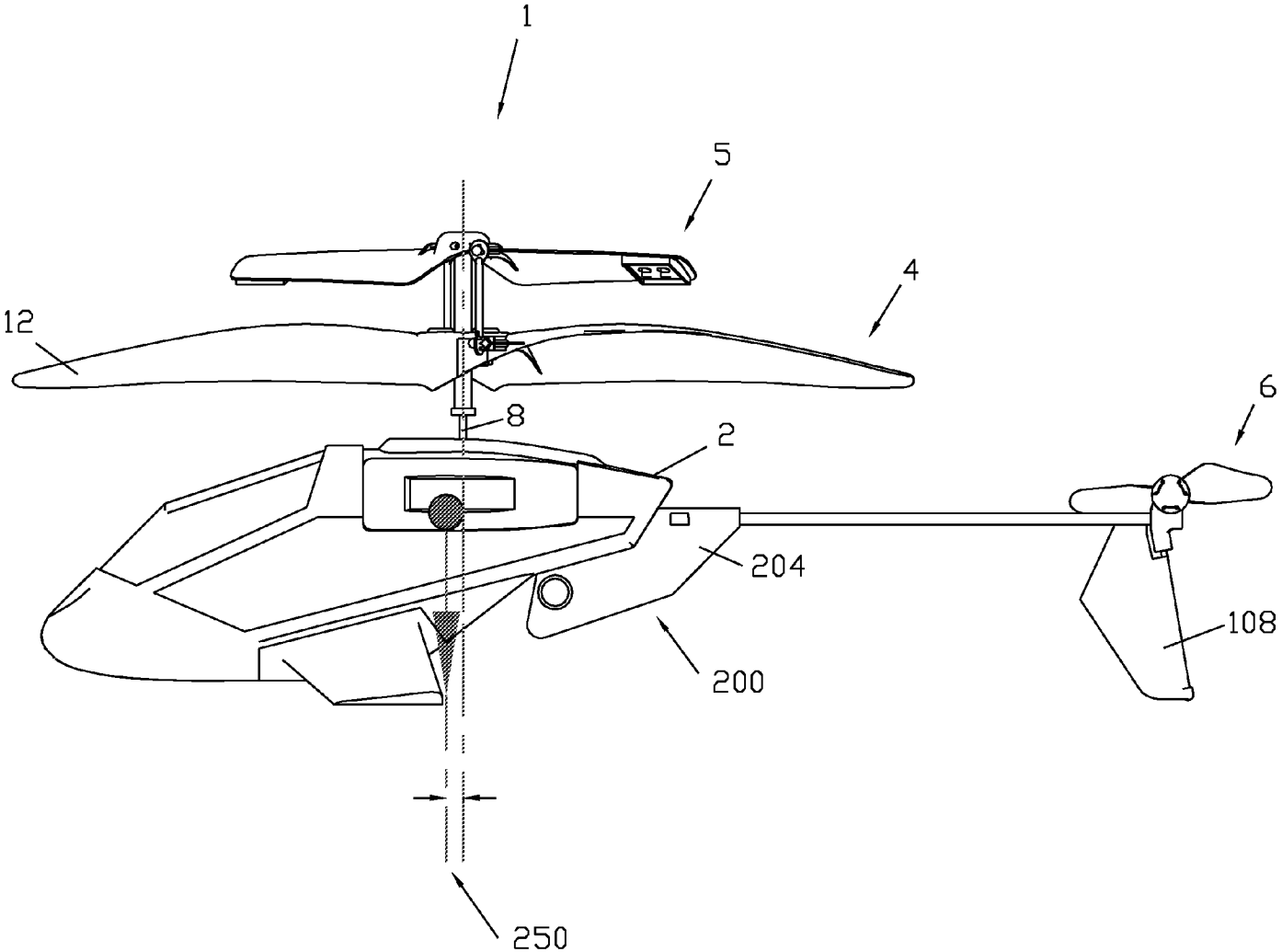
Figure 24:
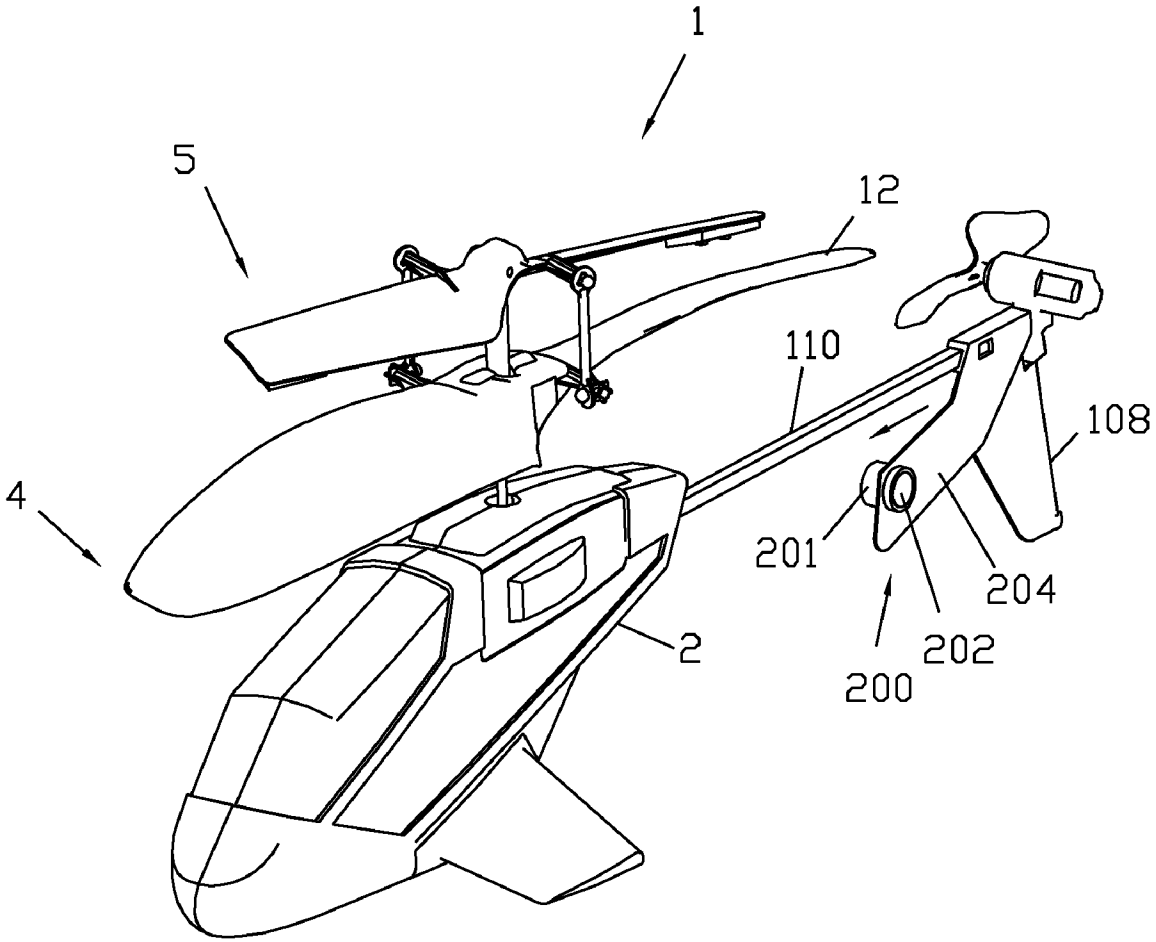
Figure 25:
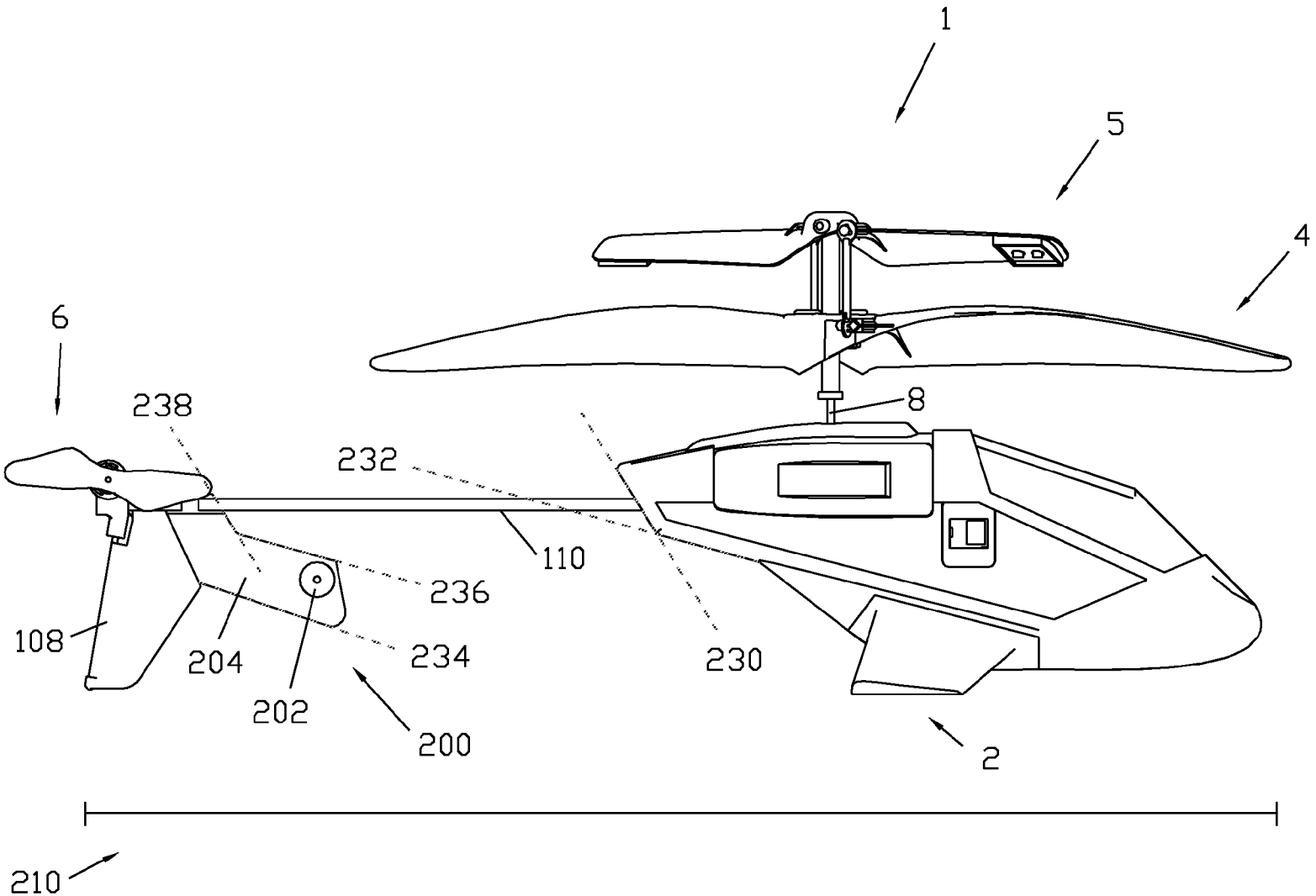
Figure 26:
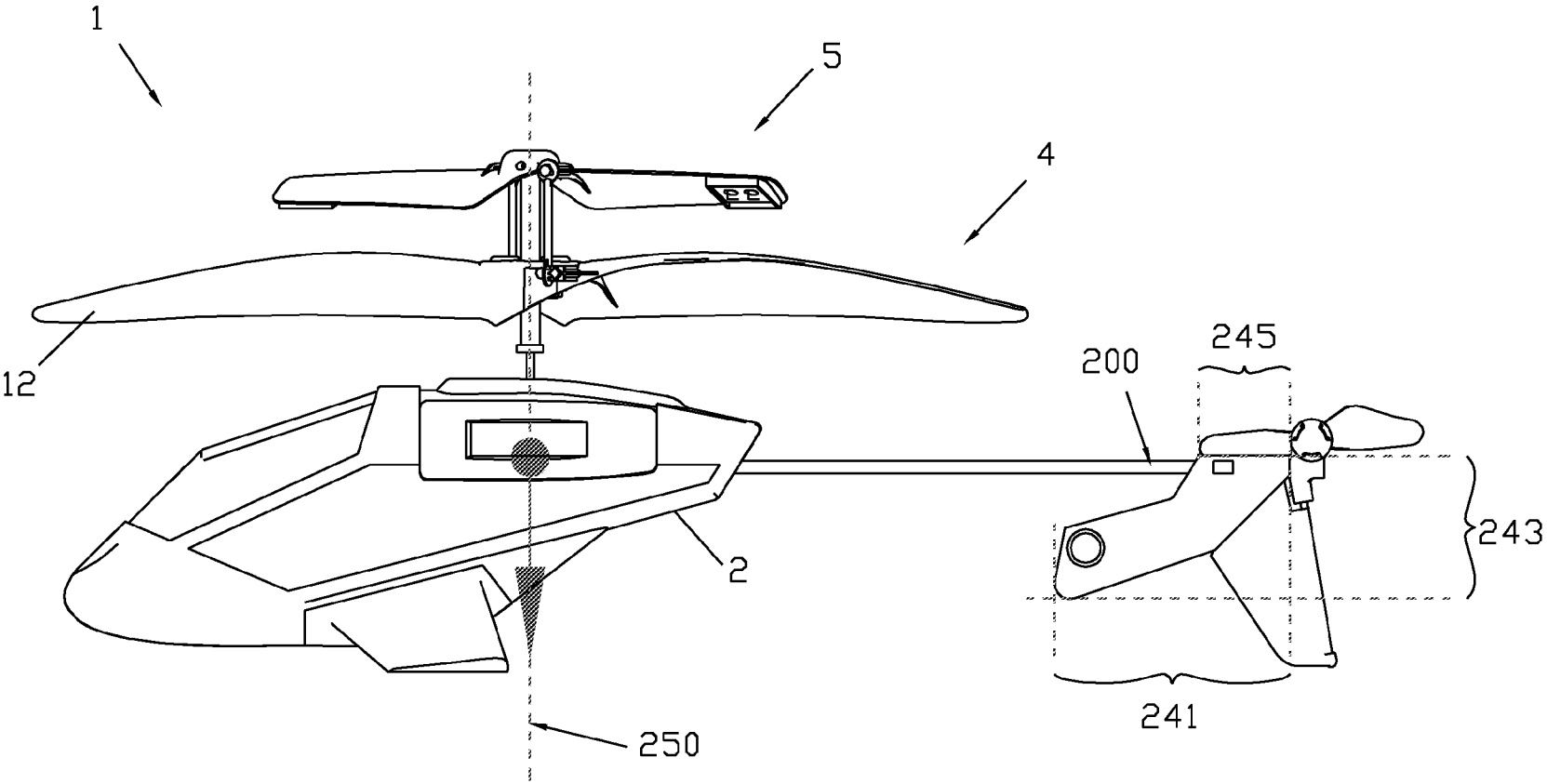
Figure 27:
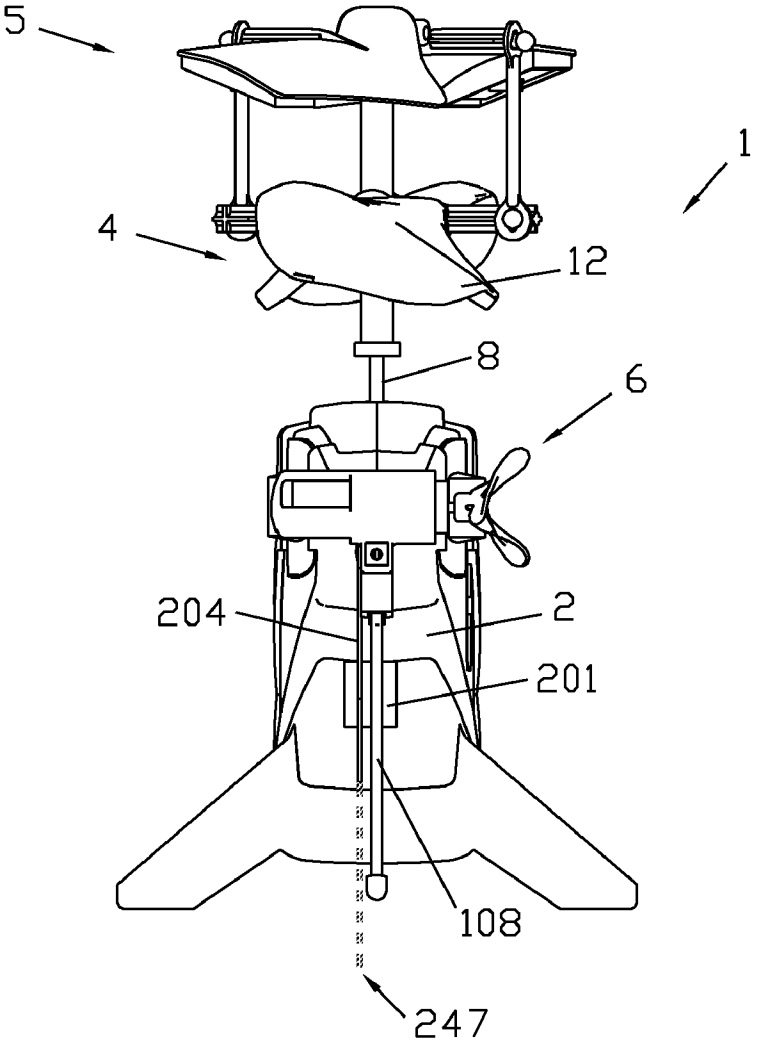
Figure 28:
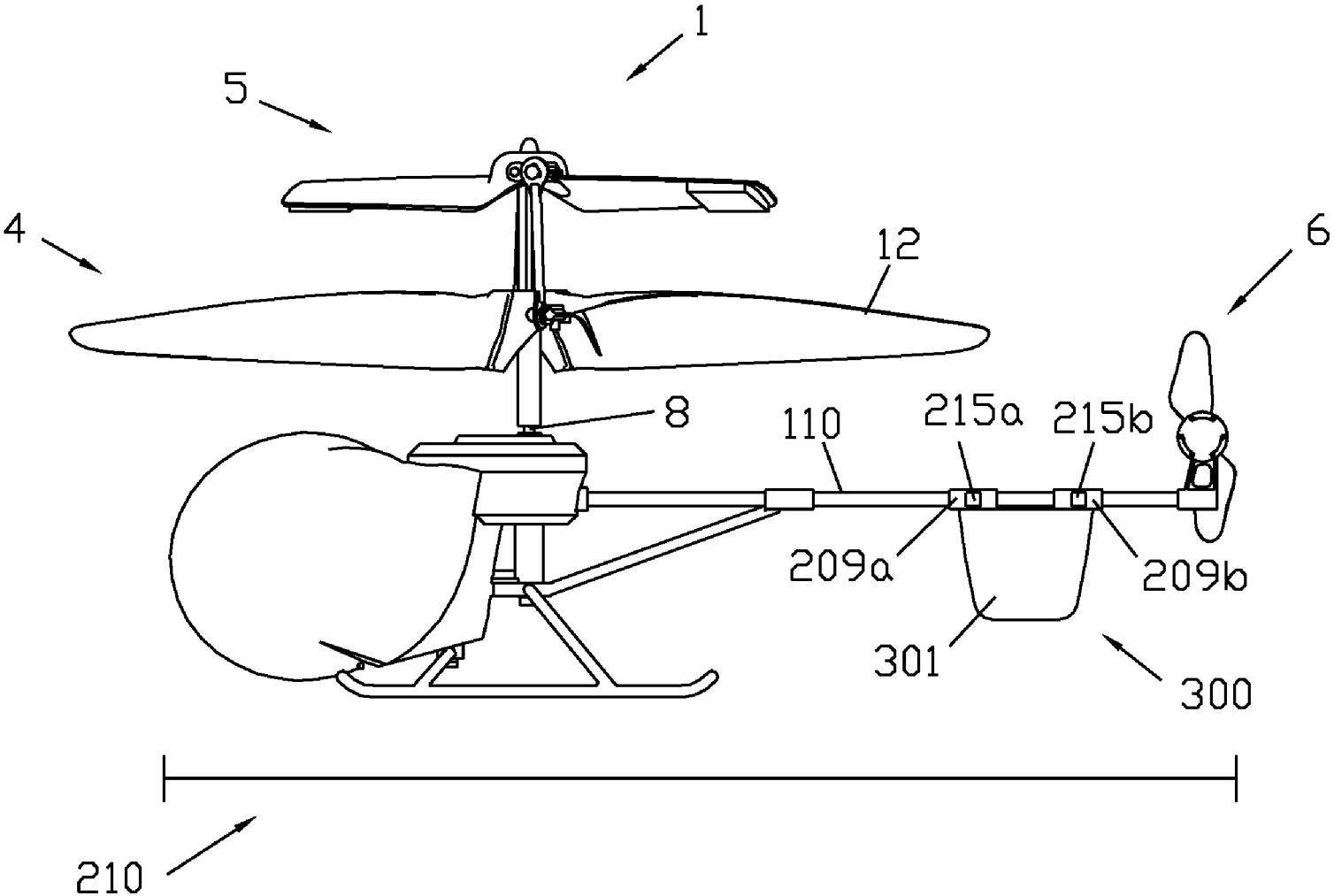
Figure 29:
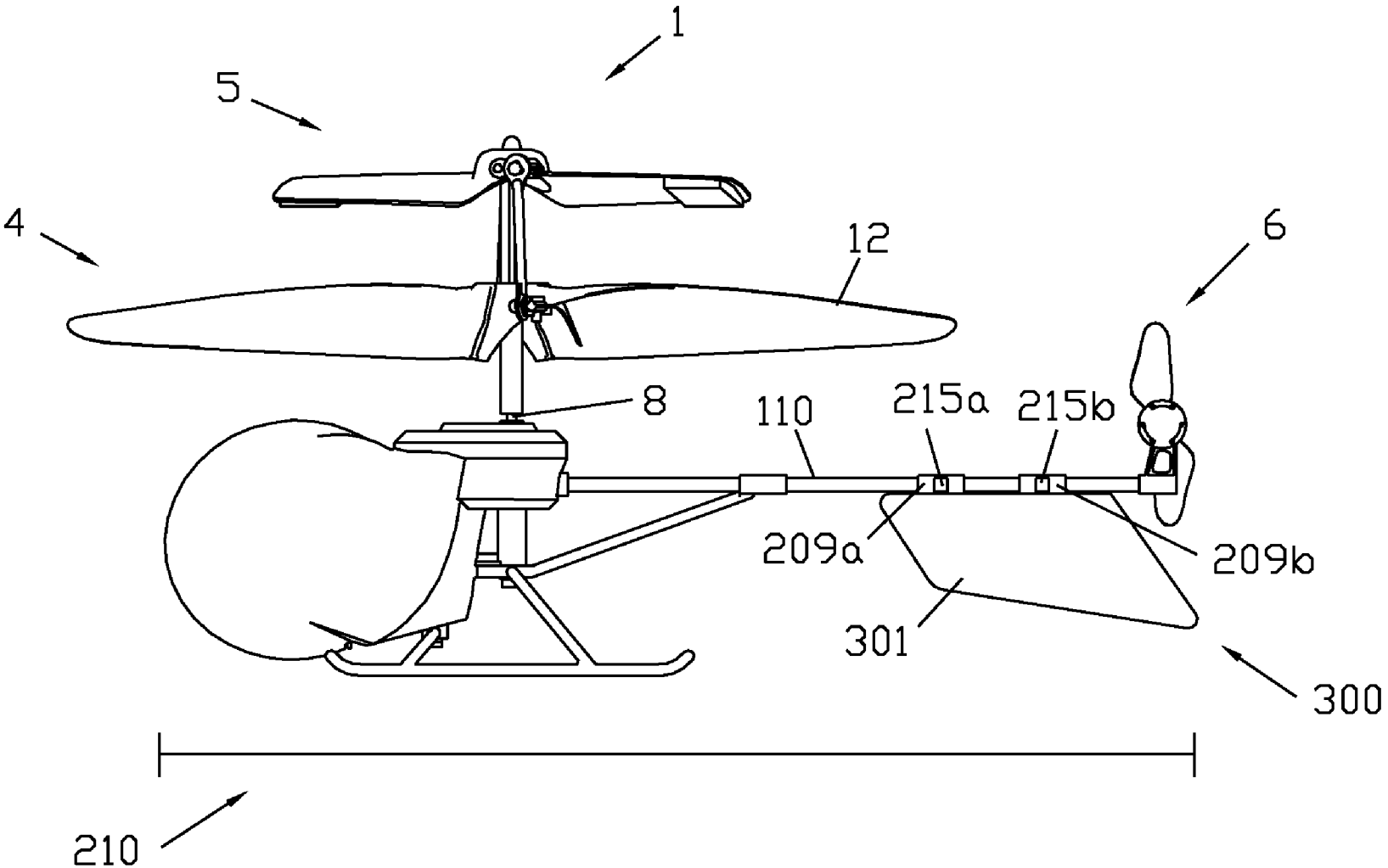

FIG. 19*a* represent a perspective view of an embodiment of the helicopter;

FIG. 19*b* represent a perspective view of an embodiment of a movable element of the helicopter;

FIG. 20*a* represent a perspective view of an embodiment of the helicopter;

FIG. 20*b* represent a perspective view of an embodiment of the movable element of the helicopter;

FIG. 21 represent a perspective view of an embodiment of the helicopter;

FIG. 22 represents a side view of an embodiment of the helicopter;

FIG. 23 represents a side view of an embodiment of the helicopter;

FIG. 24 represent a perspective view of an embodiment of the helicopter;

FIG. 25 represent a side view of an embodiment of the helicopter;

FIG. 26 represents a side view of an embodiment of the helicopter;

FIG. 27 represents a rear view of an embodiment of the helicopter;

FIG. 28 represents a side view of an embodiment of the helicopter;

FIG. 29 represents a side view of an embodiment of the helicopter.

DETAILED DESCRIPTION

Typically, a helicopter includes a body, a main rotor and a tail rotor.

The main rotor provides an upward force to keep the helicopter in the air, as well as a lateral or forward or backward force to steer the helicopter in required directions. This can be by making the angle of incidence of the propeller blades of the main rotor vary cyclically at every revolution of the main rotor.

The main rotor has a natural tendency to deviate from its position, which may lead to uncontrolled movements and to a crash of the helicopter if the pilot loses control over the steering of the helicopter.

Solutions to slow down the effect have already been provided up to now, including the application of stabilizing rods and weights at the tips of the propeller blades.

All these solutions make use of the known phenomenon of gyroscopic precession caused by the Coreolis force and the centrifugal forces to obtain the desired effect.

The tail rotor is not at all insensitive to this phenomenon, since it has to prevent the body from turning around the drive shaft of the rotor as a result of the resistance torque of the rotor on the body.

To this end, the tail rotor is erected such that it develops a lateral thrust which has to counteract the above-mentioned resistance torque of the rotor and the helicopter is provided with means which have to enable the pilot to control the lateral thrust so as to determine the flight position round the vertical axis.

Since the tail of the helicopter tends to turn round the drive shaft of the main rotor, even in case of small variations in the drive torque of the main rotor, most helicopters are provided with a separate and autonomous mechanical or electromechanical system such as a gyroscope or the like which automatically compensates the thrust of the tail rotor for the unwanted rotations.

In general, the stability of a helicopter includes the result of the interaction between:

the rotation of the rotor blades; the movements of any possible stabilizing rods; compensation of the resistance torque of the main rotor by means of the tail rotor;

the system such as a gyroscope or the like to compensate for small undesired variations in the resistance torque of the main rotor; and control of the helicopter which controls the rotational speed of the main rotor and of the tail rotor.

When these elements are essentially in balance, the pilot should be able to steer the helicopter as desired.

This does not mean, however, that the helicopter can fly by itself and can thus maintain a certain flight position or maneuver, for example, hovering or making slow movements without the intervention of a pilot.

Moreover, flying a helicopter usually requires intensive training and much experience of the pilot, for both a full size operational real helicopter as well as a toy helicopter or a remote-controlled model helicopter.

The present disclosure aims to minimize one or several of the above-mentioned and other disadvantages by providing a simple and cheap solution to auto stabilize the helicopter, such that operating the helicopter becomes simpler and possibly reduces the need for long-standing experience of the pilot.

The helicopter should meet the following requirements to a greater or lesser degree:

(a) it can return to a stable hovering position, in case of an unwanted disturbance of the flight conditions. Such disturbance may occur in the form of a gust of wind, turbulences, a mechanical load change of the body or the rotors, a change of position of the body as a result of an adjustment to the cyclic variation of the pitch or angle of incidence of the propeller blades of the main rotor or a steering of the tail rotor or the like with a similar effect; and (b) the time required to return to the stable position should be relatively short and the movement of the helicopter should be relatively small.

To this end, the disclosure concerns an improved helicopter including a body with a tail; a main rotor with propeller blades which are driven by a rotor shaft and which are hinge-mounted to the rotor shaft by means of a joint. The angle between the surface of rotation of the main rotor and the rotor shaft may vary. A tail rotor is driven by a second rotor shaft which is directed transversal to the rotor shaft of the main rotor.

The helicopter is provided with an auxiliary rotor which is driven by the shaft of the main rotor and which is provided with two vanes extending essentially in line with their longitudinal axis. The "longitudinal" axis is seen in the sense of rotation of the main rotor, and is essentially parallel to the longitudinal axis of at least one of the propeller blades of the main rotor or is located within a relatively small acute angle with the latter propeller blade axis. This auxiliary rotor is provided in a swinging manner on an oscillatory shaft which is provided essentially transversal to the rotor shaft of the main rotor. This is directed essentially transverse to the longitudinal axis of the vanes. The main rotor and the auxiliary rotor are connected to each other through a mechanical link, such that the swinging motions of the auxiliary rotor control the angle of incidence of at least one of the propeller blades of the main rotor.

In practice, it appears that such an improved helicopter is more stable and stabilizes itself relatively quickly with or without a restricted intervention of the user.

According to different aspects of the disclosure, the helicopter is made more stable by suspending the tail rotor with its rotor shaft in a swing which can rotate round a swing shaft. The swing shaft essentially extends in the longitudinal direction relative to the body of the helicopter.

In case of malfunction or the like, whereby the helicopter starts to turn round the rotor shaft of the main rotor in an unwanted manner, the tail rotor, as a result of the gyroscopic precession acting on the rotating tail rotor as a result of the rotation round the rotor shaft of the main rotor, should tilt round the swing shaft of the tail rotor at a certain angle.

By measuring the relative angular displacement of the swing and by using the measured signal as an input signal for a microprocessor which controls the drive of the main rotor and the drive of the tail rotor as a function of a stabilizer algorithm, the thrust of the tail rotor can be adjusted so as to counteract the unwanted effect of the disturbance and to thus automatically restore the stable flight conditions for the helicopter, with minimal or any intervention of the pilot.

The main rotor with propeller blades is driven by a rotor shaft on which the blades are mounted. The auxiliary rotor is driven by the rotor shaft of the main rotor and is provided with vanes from the rotor shaft in the sense of rotation of the main rotor.

The auxiliary rotor is mounted in a swinging relationship on an oscillatory shaft and the swinging motion being relatively upwardly and downwardly about the auxiliary shaft. The auxiliary shaft is provided essentially transverse to the rotor shaft of the main rotor. The main rotor and the auxiliary rotor are connected to each other by a mechanical link, such that the swinging motion of the auxiliary rotor controls the angle of incidence of at least one of the propeller blades of the main rotor.

The angle of incidence of the rotor in the plane of rotation of the rotor and the rotor shaft may vary; and an auxiliary rotor rotatable with the rotor shaft is for relative oscillating movement about the rotor shaft. Different relative positions are such that the auxiliary rotor causes the angle of incidence the main rotor to be different. A linkage between the main and auxiliary rotor causes changes in the position of the auxiliary rotor to translate to changes in the angle of incidence.

The propeller blades of the main rotor and the vanes of the auxiliary rotor respectively are connected to each other with a mechanical linkage that permits the relative movement between the blades of the propeller and the vanes of the auxiliary rotor.

There are wings directed transversely to a longitudinal axis of the helicopter body directed transversely and downwardly and a downwardly directed stabilizer at the tail of the helicopter. This facilitates stability on the ground.

In one embodiment, there is an element movable along a longitudinal length of a remote control toy helicopter. The element comprises a body for attachment to a helicopter. The body is selectively movable to different operating positions along a longitudinal length of the helicopter to change the center of gravity of helicopter. The body is about 1 to about 15 percent, preferably about 3 to about 10 percent, of the weight of the helicopter. Selective movement of the body along the longitudinal length changes the speed of the helicopter. The body can be hung from a boom of the remote control helicopter. The center of gravity of the helicopter is shifted according to the position of the body along the longitudinal length of the helicopter. The body can be a fin, such that air flow from the main rotor exerts pressure on the fin for counteracting a turning moment induced by torque of the main rotor. The fin can also be hung from a boom.

In another embodiment, a remote control toy helicopter comprises a body that has a longitudinal length, a main motor and a battery for the main motor. The main motor is controllable by a controller remote from the body. There is a main rotor with propeller blades driven by the main motor and a body attached to the helicopter. The body is selectively movable to different operating positions along the longitudinal length to change the center of gravity of the remote control toy helicopter. The helicopter may further comprise a boom and the body may include two attachments for attaching the body to the boom. The element is about 1 to about 15 percent, preferably about 3 to about 10 percent, of the weight of the helicopter.

In another embodiment, a remote control toy helicopter comprises a body that has a longitudinal length, a main motor and a battery for the main motor. The main motor is controllable by a controller remote from the body. There is a main rotor with propeller blades driven by the main motor and a body attached to the helicopter. There is a main rotor having two propeller blades mounted on a rotor shaft driven by the main motor and an auxiliary rotor mounted on the rotor shaft of the main rotor for rotation in the sense of the main rotor. There is a movable fin attached along the longitudinal length and a weight fixed to the movable fin. Selective movement of the movable fin to different operating positions along the longitudinal length of a remote control toy helicopter changes the center of gravity of the remote control toy helicopter. The movable fin is attached to a boom of the remote control toy helicopter for slidable adjustment along the length of the boom. The movable fin may have an undercut substantially complimentary in shape to a portion of the body and wherein the movable fin in a forward position is substantially located under the body. The boom has a downwardly directed stabilizer and, in a rearward position, the movable fin may overlap a portion of the downwardly directed stabilizer.

The helicopter 1 represented in the figures by way of example is a remote-controlled helicopter which essentially consists of a body 2 with a landing gear and a tail 3; a main rotor 4; an auxiliary rotor 5 driven synchronously with the latter and a tail rotor 6.

The main rotor 4 is provided by means of what is called a rotor head 7 on a first upward directed rotor shaft 8 which is bearing-mounted in the body 2 of the helicopter 1 in a rotating manner and which is driven by means of a motor 9 and a transmission 10, whereby the motor 9 is, for example, an electric motor which is powered by a battery 11.

The main rotor 4 in this case has two propeller blades 12 which are in line or practically in line, but which may just as well be composed of a larger number of propeller blades 12.

Figure 6:
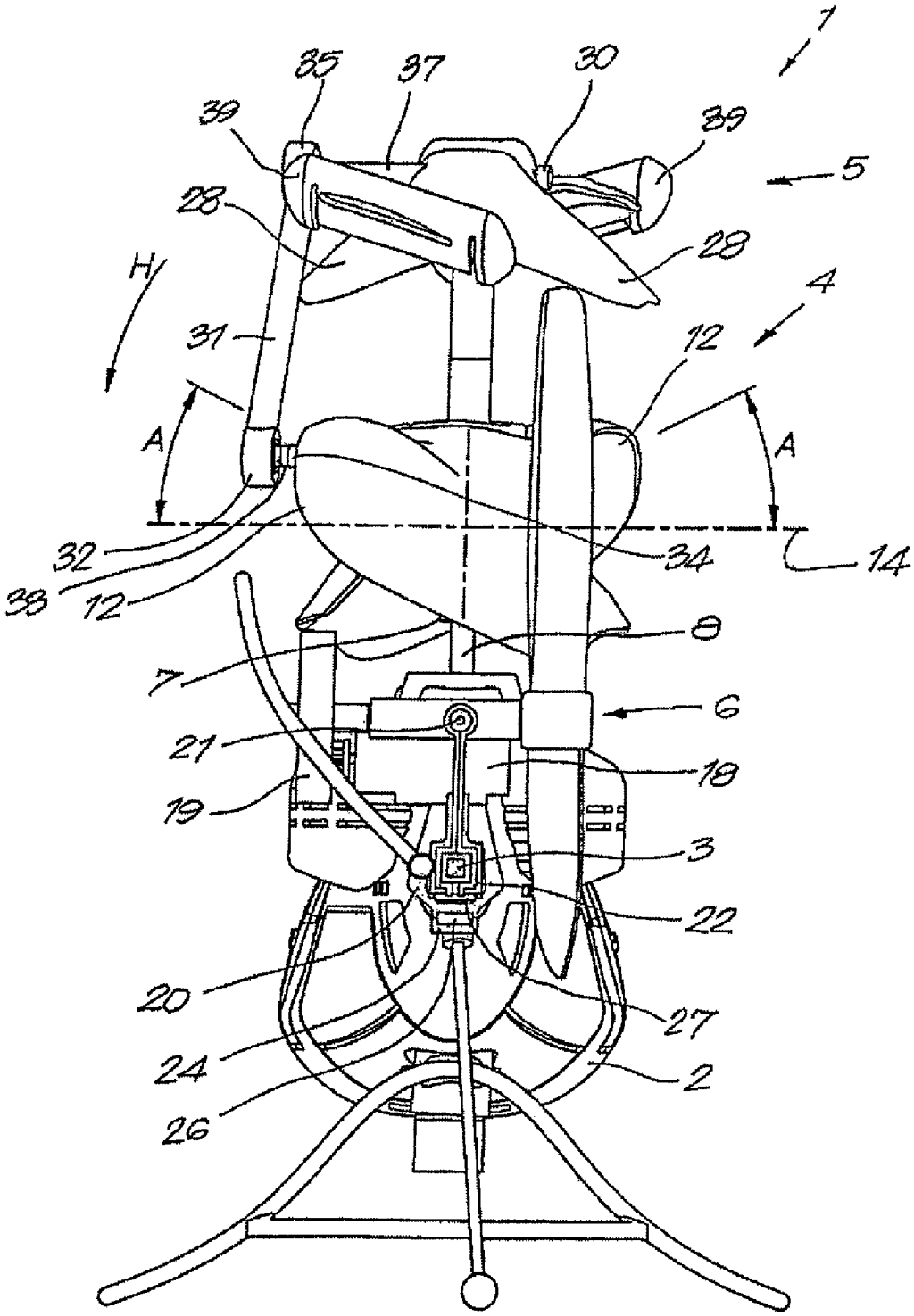
FIG. 6 is a rear view according to arrow F6 in FIG. 5.

The tilt or angle of incidence A of the propeller blades 12, in other words the angle A which forms the propeller blades 12 as represented in FIG. 6 with the plane of rotation 14 of the main rotor 4, can be adjusted as the main rotor 4 is hinge-mounted on this rotor shaft 8 by means of a joint, such that the angle between the plane of rotation of the main rotor and the rotor shaft may freely vary.

In the case of the example of a main rotor 4 with two propeller blades 12, the joint is formed by a spindle 15 of the rotor head 7.

Figure 1:
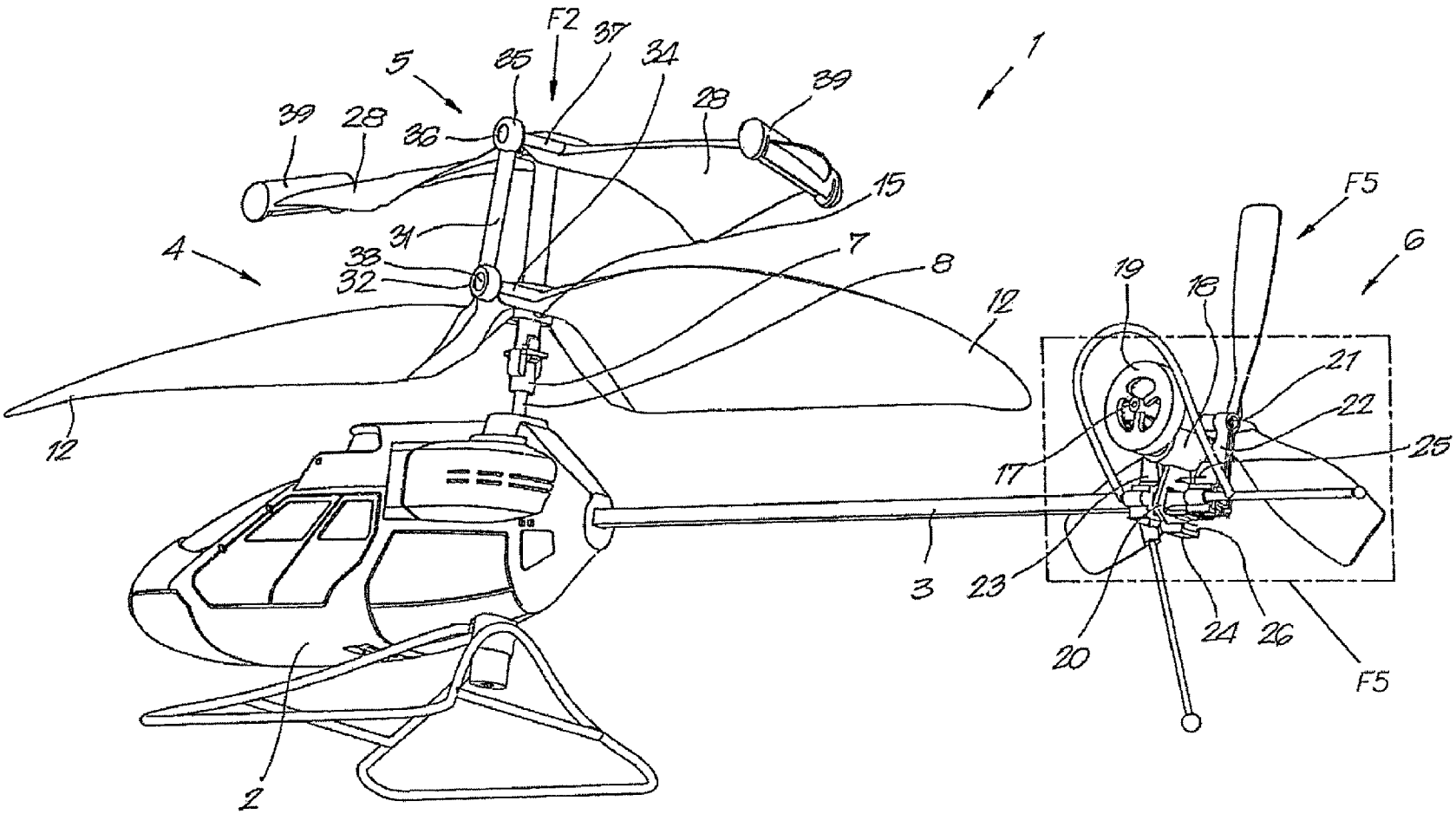
Figure 2:
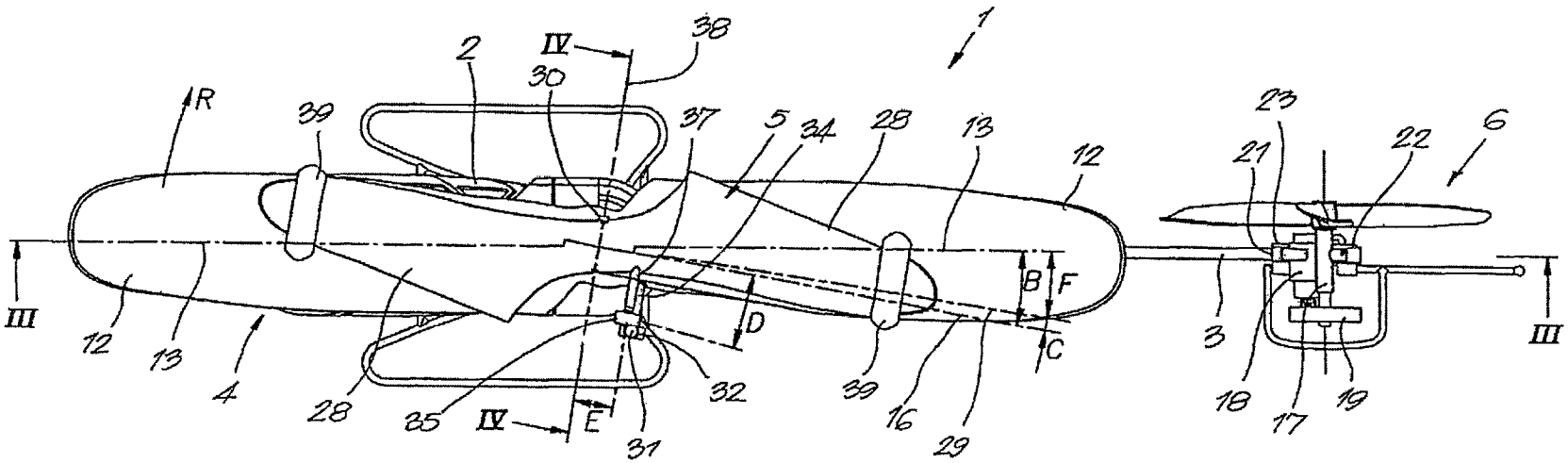
FIG. 2 represents a top view according to arrow F2 in FIG. 1.
Figure 3:
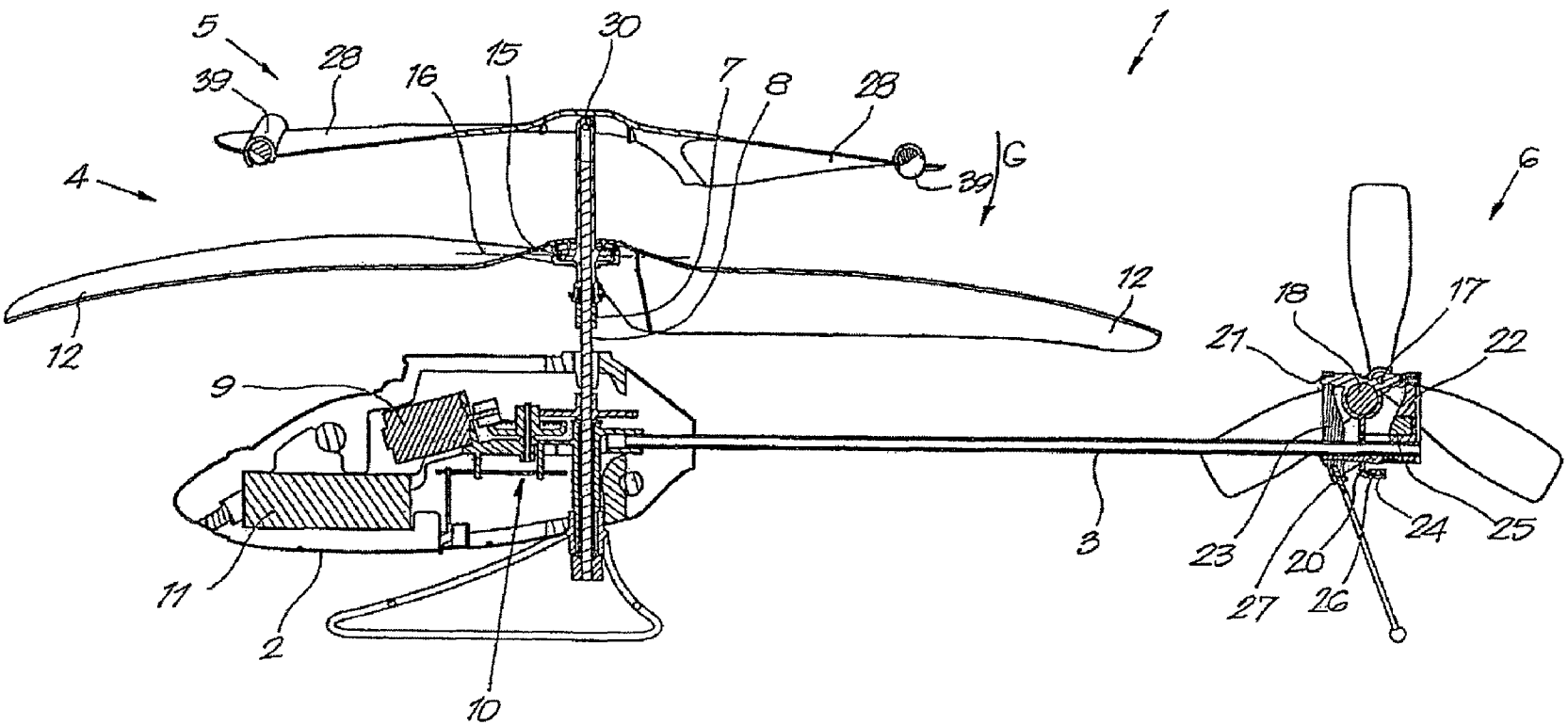
FIGS. 3 and 4 represent respective sections according to lines II-II and III-III in FIG. 2.
Figure 4:
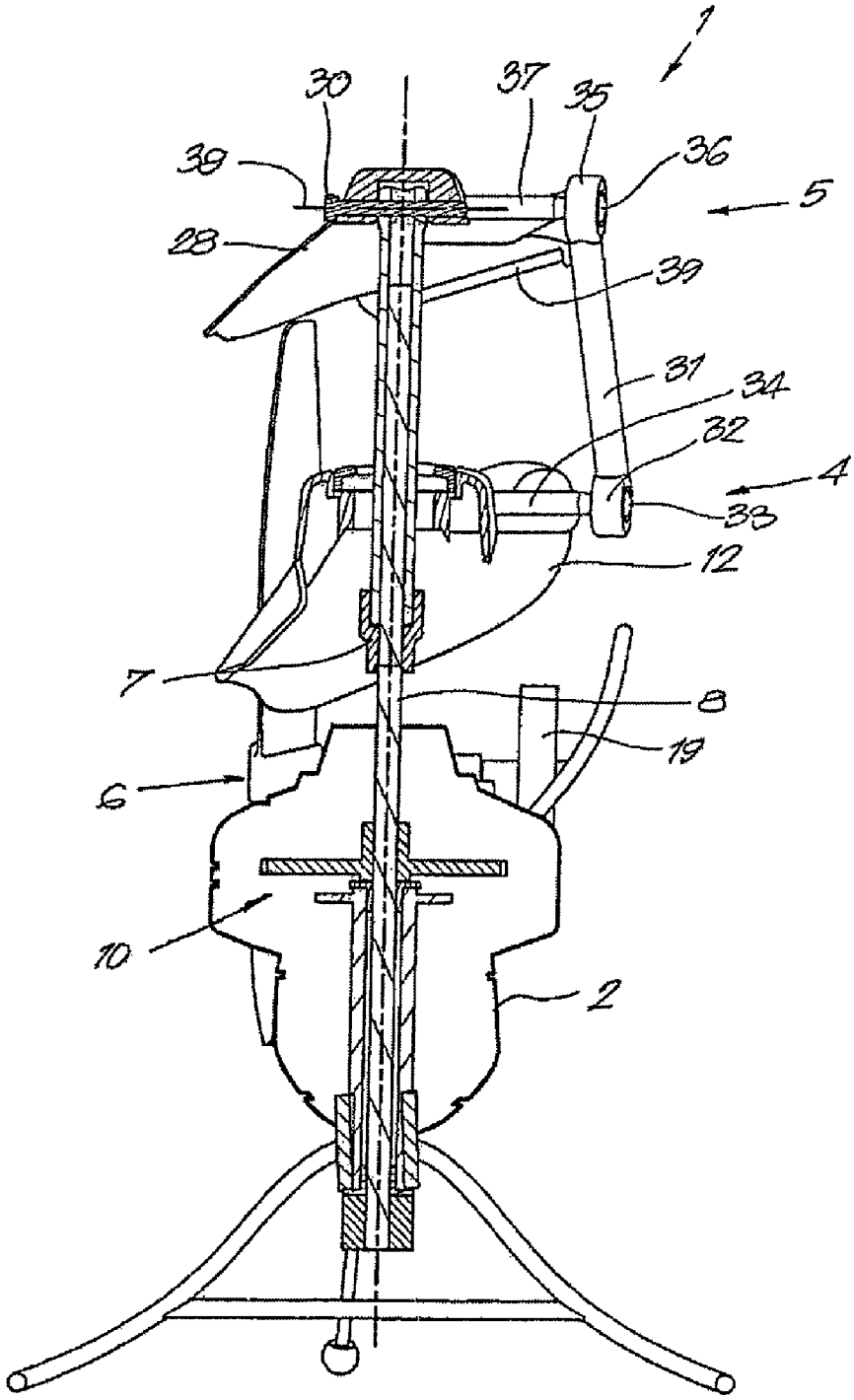
Figure 5:
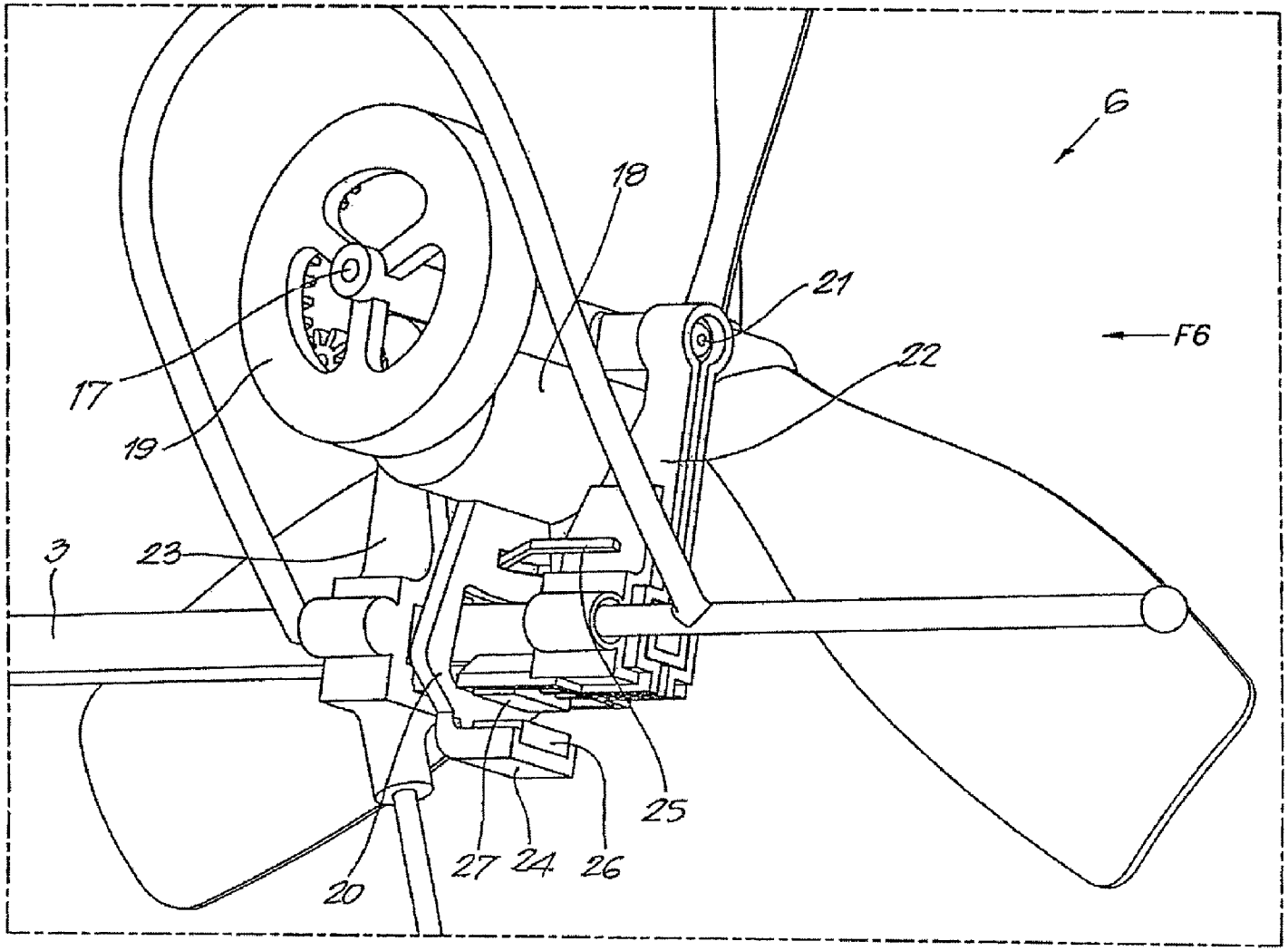
FIG. 5 represents a view of the rear rotor part indicated in FIG. 1 by F5 to a larger scale.

The axis 16 of this spindle 15 is directed transversal to the rotor shaft 8 and essentially extends in the direction of the longitudinal axis 13 of one of the propeller blades 12 and it preferably forms, as represented in FIG. 2, an acute angle B with this longitudinal axis 13.

The tail rotor 6 is driven via a second rotor shaft 17 by means of a second motor 18 and a transmission 19. Motor 16 can be an electric motor. The tail rotor 6 with its rotor shaft 17 and its drive 18-19 is suspended in a swing 20 which can rotate round a swing shaft 21 which is fixed to the tail 3 of the helicopter 1 by two supports 22 and 23.

The swing 20 is provided with an extension piece 24 towards the bottom, which is kept in a central position by means of a spring 25 when in a state of rest, whereby the second rotor shaft 17 in this position is horizontal and directed crosswise to the first rotor shaft 8.

On the lower end of the extension piece 24 of the swing 20 is provided a magnet 26, whereas opposite the position of the magnet 26 in the above-mentioned state of rest of the swing 20 is fixed a magnetic sensor 27 to the tail 3 which makes it possible to measure the relative angular displacement of the swing 20 and thus of the tail rotor 6 round the swing shaft 21.

It is clear that this angular displacement of the swing 20 can also be measured in other ways, for example by means of a potentiometer.

The measured signal can be used as an input signal for a control box, which is not represented in the figures, which controls the drives of the main rotor 4 and of the tail rotor 6 and which is provided with a stabilizer algorithm which will give a counter steering command when a sudden unwanted angular displacement of the tail rotor 6 is measured round the swing shaft 21, resulting from an unwanted rotation of the helicopter 1 round the rotor shaft 8, so as to restore the position of the helicopter 1.

The helicopter 1 is also provided with an auxiliary rotor 5 which is driven substantially synchronously with the main rotor 4 by the same rotor shaft 8 and the rotor head 7.

The main rotor 4 in this case has two vanes 28 which are essentially in line with their longitudinal axis 29, whereby the longitudinal axis 29, seen in the sense of rotation R of the main rotor 4, is essentially parallel to the longitudinal axis 13 of propeller blades 12 of the main rotor 4 or encloses a relatively small acute angle C with the latter, so that both rotors 4 and 5 extend more or less parallel on top of one another with their propeller blades 12 and vanes 28.

The diameter of the auxiliary rotor 5 is preferably smaller than the diameter of the main rotor 4 as the vanes 28 have a smaller span than the propeller blades 12, and the vanes 28 are substantially rigidly connected to each other. This rigid whole forming the auxiliary rotor 5 is provided in a swinging manner on an oscillating shaft 30 which is fixed to the rotor head 7 of the rotor shaft 8. This is directed transversally to the longitudinal axis of the vanes 28 and transversally to the rotor shaft 8.

The main rotor 4 and the auxiliary rotor 5 are connected to each other by a mechanical link which is such of the auxiliary rotor 5 the angle of incidence A of at least one of the propeller blades 12 of the main rotor 4. In the given example this link is formed of a rod 31.

This rod 31 is hinge-mounted to a propeller blade 12 of the main rotor 4 with one fastening point 32 by means of a joint 33 and a lever arm 34 and with another second fastening point 35 situated at a distance from the latter, it is hinge-mounted to a vane 28 of the auxiliary rotor 5 by means of a second joint 36 and a second lever arm 37.

The fastening point 32 on the main rotor 4 is situated at a distance D from the axis 16 of the spindle 15 of the propeller blades 12 of the main rotor 4, whereas the other fastening point 35 on the auxiliary rotor 5 is situated at a distance E from the axis 38 of the oscillatory shaft 30 of the auxiliary rotor 5.

The distance D is preferably larger than the distance E, and about the double of this distance E, and both fastening points 32 and 35 of the rod 31 are situated, seen in the sense of rotation R on the same side of the propeller blades 12 of the main rotor 4 or of the vanes 28 of the auxiliary rotor 5, in other words they are both situated in front of or at the back of the propeller blades 12 and vanes 28, seen in the sense of rotation.

Also preferably, the longitudinal axis 29 of the vanes 28 of the auxiliary rotor 5, seen in the sense of rotation R, encloses an angle F with the longitudinal axis 13 of the propeller blades 12 of the main rotor 4, which enclosed angle F is in the order, of magnitude of about 10°, whereby the longitudinal axis 29 of the vanes 28 leads the longitudinal axis 13 of the propeller blades 12, seen in the sense of rotation R. Different angles in a range of, for example, 5° to 25° could also be in order.

The auxiliary rotor 5 is provided with two stabilizing weights 39 which are each fixed to a vane 28 at a distance from the rotor shaft 8.

Further, the helicopter 1 is provided with a receiver, so that it can be controlled from a distance by means of a remote control which is not represented.

As a function of the type of helicopter, it is possible to search for the most appropriate values and relations of the angles B, F and G by experiment; the relation between the distances D and E; the size of the weights 39 and the relation of the diameters between the main rotor 4 and the auxiliary rotor 5 so as to guarantee a maximum auto stability.

The operation of the improved helicopter 1 according to the disclosure is as follows:

In flight, the rotors 4, 5 and 6 are driven at a certain speed, as a result of which a relative air stream is created in relation to the rotors, as a result of which the main rotor 4 generates an upward force so as to make the helicopter 1 rise or descend or maintain a certain height, and the tail rotor 6 develops a laterally directed force which is used to steer the helicopter 1.

It is impossible for the main rotor 4 to adjust itself, and it will turn in the plane 14 in which it has been started, usually the horizontal plane. Under the influence of gyroscopic precession, turbulence and other factors, it will take up an arbitrary undesired position if it is not controlled.

The surface of rotation of the auxiliary rotor 5 may take up another inclination in relation to the surface of rotation 14 of the main rotor 8, whereby both rotors 5 and 4 may take up another inclination in relation to the rotor, shaft 8.

This difference in inclination may originate in any internal or external force or disturbance whatsoever.

In a situation whereby the helicopter 1 is hovering stable, on a spot in the air without any disturbing internal or external forces, the auxiliary rotor 5 keeps turning in a plane which is essentially perpendicular to the rotor shaft 8.

If, however, the body 2 is pushed out of balance due to any disturbance whatsoever, and the rotor shaft 8 turns away from its position of equilibrium, the auxiliary rotor 5 does not immediately follow this movement, since the auxiliary rotor 5 can freely move round the oscillatory shaft 30.

The main rotor 4 and the auxiliary rotor 5 are placed in relation to each other in such a manner that a swinging motion of the auxiliary rotor 5 is translated almost immediately in the pitch or angle of incidence A of the propeller blades 12 being adjusted.

For a two-bladed main rotor 4, this means that the propeller blades 12 and the vanes 28 of both rotors 4 and 5 must be essentially parallel or, seen in the sense of rotation R, enclose an acute angle with one another of for example 10° in the case of a large main rotor 4 and a smaller auxiliary rotor 5.

This angle can be calculated or determined by experiment for any helicopter 1 or per type of helicopter.

If the axis of rotation 8 takes up another inclination than the one which corresponds to the above-mentioned position of equilibrium in a situation whereby the helicopter 1 is hovering, the following happens:

A first effect is that the auxiliary rotor 5 will first try to preserve its absolute inclination, as a result of which the relative inclination of the surface of rotation of the auxiliary rotor 5 in relation to the rotor shaft 8 changes.

As a result, the rod 31 will adjust the angle of incidence A of the propeller blades 12, so that the upward force of the propeller blades 12 will increase on one side of the main rotor 4 and will decrease on the diametrically opposed side of this main rotor.

Since the relative position of the main rotor 4 and the auxiliary rotor 5 are selected such that a relatively immediate effect is obtained. This change in the upward force makes sure that the rotor shaft 8 and the body 21 are forced back into their original position of equilibrium.

A second effect is that, since the distance between the far ends of the vanes 28 and the plane of rotation 14 of the main rotor 4 is no longer equal and since also the vanes 28 cause an upward force, a larger pressure is created between the main rotor 4 and the auxiliary rotor 5 on one side of the main rotor 4 than on the diametrically opposed side.

A third effect plays a role when the helicopter begins to tilt over to the front, to the back or laterally due to a disturbance. Just as in the case of a pendulum, the helicopter will be inclined to go back to its original situation. This pendulum effect does not generate any destabilizing gyroscopic forces as with the known helicopters that are equipped with a stabilizer bar directed transversally to the propeller blades of the main rotor. It acts to reinforce the first and the second effect.

The effects have different origins but have analogous natures. They reinforce each other so as to automatically correct the position of equilibrium of the helicopter 1 without any intervention of a pilot.

The tail rotor 6 is located in a swinging manner and provides for an additional stabilization and makes it possible for the tail rotor 6 to assume the function of the gyroscope which is often used in existing helicopters, such as model helicopters.

In case of a disturbance, the body 2 may start to turn round the rotor shaft 8. As a result, the tail rotor 6 turns at an angle in one or other sense round the swinging shaft 21. This is due to the gyroscopic precession which acts on the rotating tail rotor 6 as a result of the rotation of the tail rotor 6 round the rotor shaft 8. The angular displacement is a function of the amplitude of the disturbance and thus of the rotation of the body 2 round the rotor shaft 8. This is measured by the sensor 27.

The signal of the sensor 27 is used by a control box of a computer to counteract the failure and to adjust the thrust of the tail rotor 6 so as to annul the angular displacement of the tail rotor 6 which is due to the disturbance.

This can be done by adjusting the speed of the tail rotor 6 and/or by adjusting the angles of incidence of the propeller blades of the tail rotor 6, depending on the type of helicopter 1.

Figure 7:
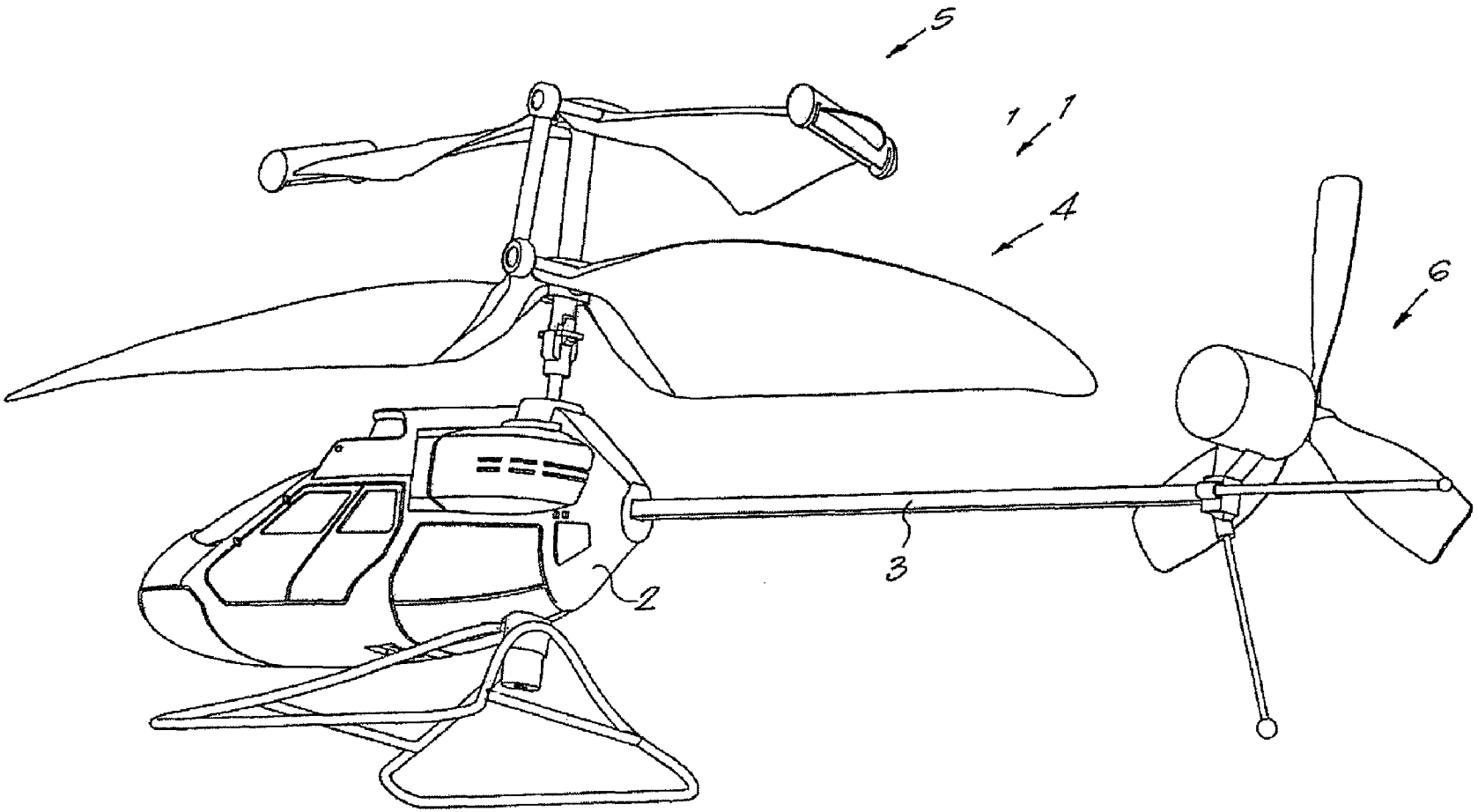
FIG. 7 represents a variant of FIG. 1.
Figure 8:
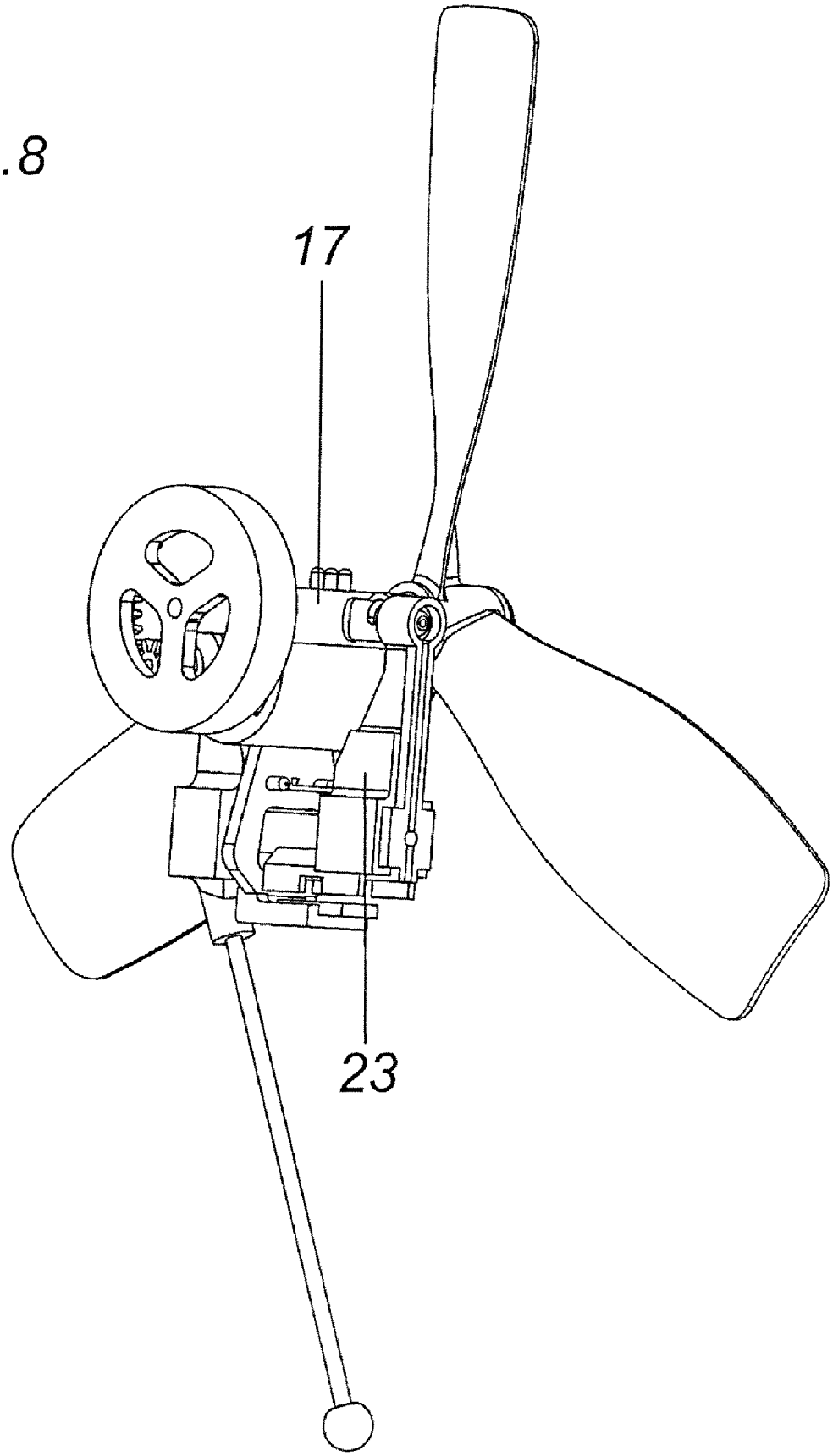
FIG. 8 represents a variant of FIG. 5.
Figure 9:
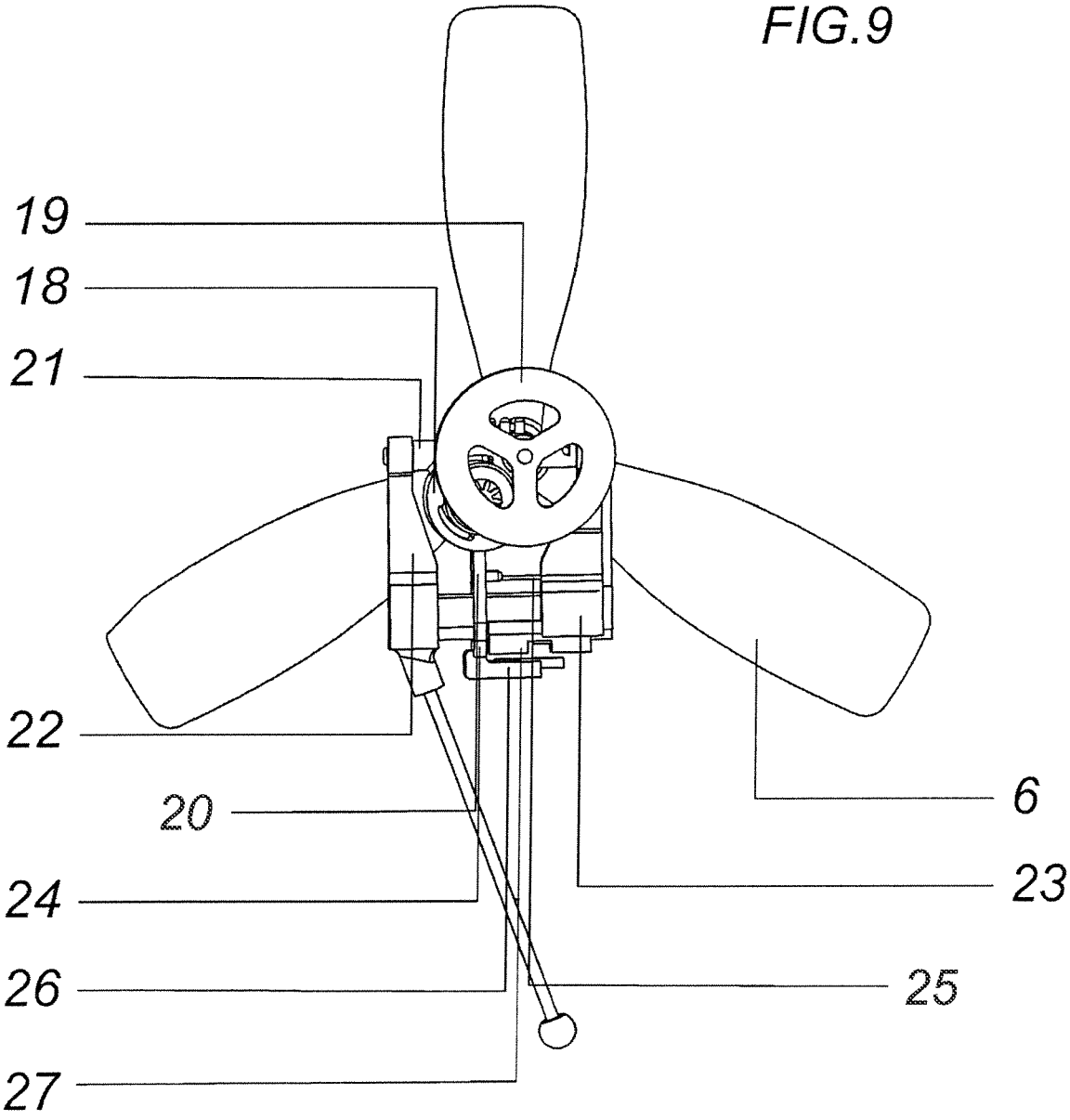
FIG. 9 represents a different view of the tail rotor of FIG. 8.
Figure 10:
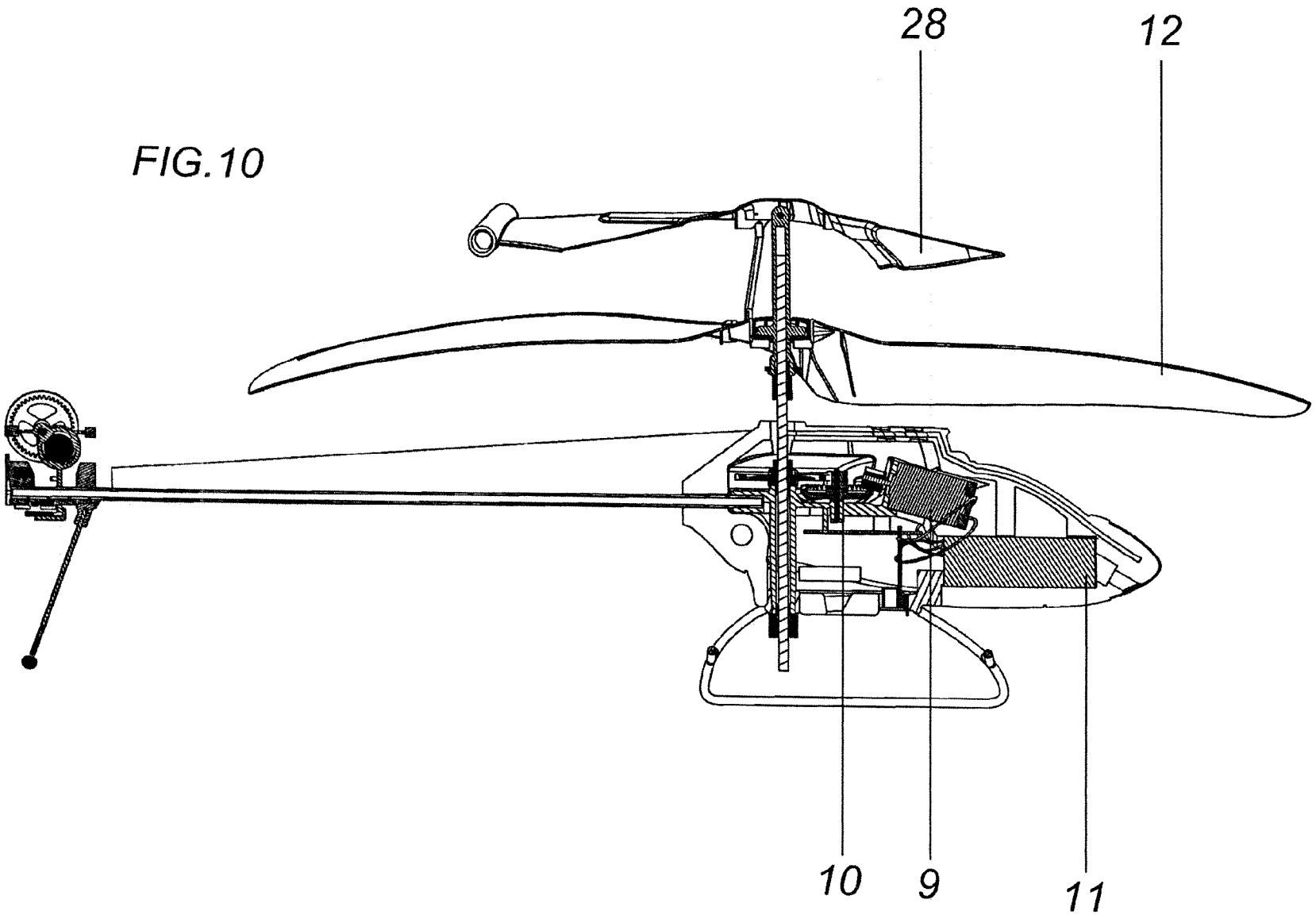
FIG. 10 represents a section of the helicopter.

If necessary, this aspect of the disclosure may be applied separately, just as the aspect of the auxiliary rotor 5 can be applied separately, as is illustrated for example by means of FIG. 7, which represents a helicopter 1 according to the disclosure having a main rotor 4 combined with an auxiliary rotor 5, but whose tail rotor 6 is of the conventional type, i.e. whose shaft cannot turn in a swing but is bearing-mounted in relation to the tail 3.

In practice, the combination of both aspects makes it possible to produce a helicopter which is very stable in any direction and any flight situation and which is easy to control, even by persons having little or no experience.

It is clear that the main rotor 4 and the auxiliary rotor 5 must not necessarily be made as a rigid whole. The propeller blades 12 and the vanes 28 can also be provided on the rotor head 7 such that they are mounted and can rotate relatively separately. In that case, for example, two rods 31 may be applied to connect each time one propeller blade 12 to one vane 28.

It is also clear that, if necessary, the joints and hinge joints may also be realized in other ways than the ones represented, for example by means of torsion-flexible elements.

In the case of a main rotor 4 having more than two propeller blades 12, one should preferably be sure that at least one propeller blade 12 is essentially parallel to one of the vanes 28 of the auxiliary rotor. The joint of the main rotor 4 is preferably made as a ball joint or as a spindle 15 which is directed essentially transversely to the axis of the oscillatory shaft 30 of the auxiliary rotor 5 and which essentially extends in the longitudinal direction of the one propeller blade 12 concerned which is essentially parallel to the vanes 28.

In another format, the helicopter comprises a body with a tail; a main rotor with propeller blades which is driven by a rotor shaft on which the blades are mounted. A tail rotor is driven by a second rotor shaft directed transversally to the rotor shaft of the main rotor. An auxiliary rotor is driven by the rotor shaft of the main rotor and is provided with vanes from the rotor shaft in the sense of rotation of the main rotor.

The auxiliary rotor is mounted in a swinging relationship on an oscillatory shaft and the swinging motion being relatively upwardly and downwardly about the auxiliary shaft. The auxiliary shaft is provided essentially transverse to the rotor shaft of the main rotor. The main rotor and the auxiliary rotor are connected to each other by a mechanical link, such that the swinging motion of the auxiliary rotor controls the angle of incidence of at least one of the propeller blades of the main rotor.

The angle of incidence of the rotor in the plane of rotation of the rotor and the rotor shaft may vary. An auxiliary rotor rotatable with the rotor shaft is for relative oscillating movement about the rotor shaft. Different relative positions are such that the auxiliary rotor causes the angle of incidence the main rotor to be different. A linkage between the main and auxiliary rotor causes changes in the position of the auxiliary rotor to translate to changes in the angle of incidence.

The propeller blades of the main rotor and the vanes of the auxiliary rotor respectively are connected to each other with a mechanical linkage that permits the relative movement between the blades of the propeller and the vanes of the auxiliary rotor. A joint of the main rotor to the propeller blades is formed of a spindle which is fixed to the rotor shaft of the main rotor.

The mechanical link includes a rod hinge mounted to a vane of the auxiliary rotor with one fastening point and is hinge-mounted with another fastening point to the propeller blade of the main rotor.

The body includes wings directed transversely of a longitudinal axis of the helicopter body. The wings are 100 and 102 directed transversely and downwardly whereby the tips 104 and 106 of the wings permit for stabilizing the helicopter body when on the ground.

There is a downwardly directed stabilizer 108 at the tail of the helicopter. FIG. 15 also shows a radio control unit for operation with the helicopter. This unit can have appropriate computerized controls for signaling the operation of the motors operating the rotors and their relative positions.

In a third embodiment, referring to FIGS. 19-28, there is an element 200 for adjusting the location of the center of gravity of the remote control toy helicopter. Represented in the figures by way of example, an element 200 has a weight 202, a fin 204 and attachment means for slidable attachment along a longitudinal length 210 of the helicopter 1. Element 200 allows a user to adjust the location of the center of gravity by moving the element 200 along the longitudinal length 210, thereby changing the velocity or speed of the helicopter 1.

The center of gravity (also called the center of mass) of a toy helicopter is designed such that the helicopter is hovering or slightly moving in a forward direction (<50 cm per second) while flying. The location of the center of gravity of the helicopter 1 is called the design CG. If the center of gravity is adjusted to be located in front of the design CG, the helicopter will fly at a greater forward velocity than a helicopter with a center of gravity located at the design CG would. If the center of gravity is adjusted to be located behind the design CG, the helicopter will fly at a slower forward velocity than a helicopter with a center of gravity located at the design CG or it may be static and hover in the air. In some cases, if the center of gravity is located to far behind the design CG, the helicopter 1 may fly backwards. Thus, the velocity of the helicopter 1 is proportional to the error between the design CG and the adjusted center of gravity.

The weight 202 is fixed to the fin 204. The fin 204 can be hung from a tail boom or boom 110 of the helicopter 1. Shown in FIGS. 19-27, the boom 110 is a thin rod with a substantially square shape cross section to which the fin 204 is slidably attached.

The fin 204 is movable along the longitudinal length 210 by a user, however, during flight the fin 204 is held stationary in the location chosen by the user. This is due to friction between the attachment means and the boom 110. Thus, there is a preferably tight fit between the attachment means and the boom 110. It is tight enough essentially not to move during flight or inclination, but loose enough to be adjusted forwardly and backwardly by a user.

The fin 204 has an undercut substantially complimentary in shape to a portion of the body 2. Shown in FIG. 25, the body 2 has two angled surfaces 230 and 232 that are complementary to two angled edges 236 and 238 of the fin 204. The angled edge 230 is the surface from which the boom 110 extends out from. The undercut allows the weight 202 to be located closer to the front of the helicopter 1 than it would be located if the weight 202 were directly attached on the boom. Thus, when the element 200 is in the forward position, the weight 202 is located substantially under the body 2, about $1/5^{th}$ the distance of the body 2 from the end of the body 2 and about half way between the end of the body 2 and the rotor shaft 8. In the forward position, the weight 202 is located closer to the front of the helicopter 1 than any point on the boom 110. When the fin 204 is in a rearward position, the fin 204 overlaps a portion of the downwardly directed stabilizer 108, thereby creating an extended downwardly directed stabilizer.

The fin 204 is attached to the boom 110 such that the fin hangs down from the boom 110. The fin 204 has a longitudinal dimension 241, a vertical dimension 243 and a substantially thin thickness 247 and a top edge 208. The longitudinal dimension 241 is about 1.5 times larger than the vertical dimension 243. The top edge 208 has dimension 245 that engages the boom 110, is substantially parallel to the boom 110 and substantially bears a majority of the weight of the element 200. The dimension 245 is shorter than the longitudinal dimension 241, thus allowing for the undercut and when the fin 204 is in the forward position, the front of the top edge 208 is a little more than half way under the length of the propeller blade 12.

The fin 204 substantially has the shape of a side view of a human jawbone, a forward protruding hook or of an angled flange. The fin 204 can be made of plastic, metal or metal alloy. The weight 202 can be made of any suitably material, preferably a metal. The weight 202 is about 1 to about 15 percent of the mass of the helicopter 1 and, preferably about 3 to about 10 percent and, thus the center of gravity of the helicopter 1 is shifted according to the position of the weight 202 along the longitudinal length 210.

Referring to FIGS. 19*b* and 27, the fin 204 has a cylinder 201 integrally formed with the fin 204 that extends perpendicular from the surface of the fin 204. The cylinder 201 is located near the front of the longitudinal dimension 241 of the fin 204, is hollow and is for holding the weight 202. The weight 202 is preferably complimentary in shape to the cylinder 201 so that the weight 202 can be pressed fitted and securely fixed into the cylinder 201. The cylinder 201 preferably extends through the surface of the fin 204 so that a portion of the weight 202 can be extended through on either side of the fin 204. The weight 202 extends through on either side so that the center of mass of the weight 202 can be located in line with the central axis of the helicopter 1 that is substantially in line with the rotor 8 when the helicopter 1 is viewed from the front or from the back.

The attachment means of the fin 204 to the boom 110 can be a square shaped ring complementary to the square cross shape of the boom 110, shown in FIG. 19*b*, for substantially locking the fin 204 steady from swinging movement around the boom 110. The square shaped ring that has four side surfaces. There is a top surface 207, a bottom surface 211 and two side surfaces 209 and 213. There can be a hole 215 in the surface 209. The hole 215 can be created by making three cuts in the form of a square and the hole 215 is made by making a fold along the edge to complete a square shape hole. The piece of the surface 209 is folded inward toward the center of the square shaped ring of the attachment means and creates the hole 215. This piece of the surface 209 that is folded inward frictionally engages the boom 110 and partially holds the element 200 in place during flight or inclination.

Alternatively, the attachment means of the fin 204 to the boom 110 can be a snap-fitted, injection molded C-shaped clip or hook that allows the element 200 to optionally detach. In such an instance, the attachment means may include the top surface 207, the bottom surface 211 and side surface 209 while omitting side surface 213. In other instances, the attachment means can be a locking screw or any other fastener, clip or spring loaded mechanism that allows longitudinal movement of the fin 204 along the boom 110.

During flight, the main rotor 4 exerts a force on the fin 204 in the form of air flow on the movable fin 204. This force counteracts a portion of the turning moment induced by torque of the main rotor 4.

Referring to FIGS. 21-26, the element 200 is movable along the length of the boom 110. FIGS. 21-23 show the helicopter 1 with the element 200 in the forward position. There is an arrow that denotes the directional movement of the element 200. FIGS. 24-26 show the helicopter 1 with the element 200 in the rearward position. FIGS. 24-26 also show an arrow that denotes the direction of relative movement of the element 200. Though it is not illustrated in the figures, the element 200 can be located at any location along the length of the boom 110 and is not limited to the forward or rearward positions.

The center of gravity of the helicopter 1 is shifted according to the position of the element 200 along the longitudinal length 210. Thus, when the element 200 is in the forward position as shown in FIGS. 21-23, the helicopter will have a greater forward velocity during flight than it would if the element 200 was in the rearward position or any other position there between. FIG. 23 illustrates the location of the center of gravity 250, relative to the rotor shaft, when the element 200 is in the forward position. In the forward position, the center of gravity 250 is in front of the axis of the rotor shaft 8. With the center of gravity 250 in front of the rotor shaft 8, the front of the helicopter 1 dips forward, the tail raises upward and there is a forward inclination of the rotor shaft 8 during flight that results in a forward velocity of the helicopter 1. A greater forward inclination of the rotor shaft 8 results in greater forward velocity.

When the element 200 is in the rearward position as shown in FIGS. 24-26, the helicopter 1 will have a slower forward velocity, relative to the helicopter 1 with element 200 in the forward position, or may hover and remain static in the air. FIG. 26 illustrates the location of the center of gravity 250, relative to the rotor shaft 8, when the element 200 is in the rearward position. In the rearward position, the center of gravity 250 is substantially in line with the axis of the rotor shaft 8. With the center of gravity 250 in line with the rotor shaft 8, the main rotor 4 and the boom 110 are substantially parallel with the horizon resulting in the helicopter 1 hovering or having a substantially static velocity during flight. If the center of gravity 250 is located behind the rotor shaft 8, the helicopter 1 will have a backward component of velocity that conflicts with the laterally directed force of the tail rotor and result in an unstable configuration. Therefore, for a helicopter with a boom and a tail rotor, such as helicopter 1, it is critical to locate the element 200 in a position so that the center of gravity 250 is in front of or in line with the rotor shaft 8. In other helicopters, such as tandem rotor helicopters, this is not necessarily the case.

If the element 200 is located at an intermediate position along the boom 110, at a location between the locations illustrated on FIGS. 24-26, the helicopter 1 will have a forward velocity that is between the forward velocity of the helicopter 1 with the element 200 in the forward position and the forward velocity of the helicopter 1 with the element 200 in the rearward position. Thus, the element 200 allows the user to adjust the helicopter 1 to a desired velocity.

Referring to FIGS. 28-29, there is another embodiment of the helicopter 1 in accordance with the present disclosure. There is element 300 that includes a body 301. The body 301 has a mass and the center of gravity of the helicopter 1 is shifted according to the position of the body 301 along the longitudinal length 201. The body 301 can be made of a material that has a sufficient weight, such as a metal, or the body 301 can be made of plastic and sufficiently thick to achieve a weight of about 1 to about 15 percent, preferably about 3 to about 10 percent, of the weight of the helicopter 1.

Referring to FIG. 28, the body 301 has the shape of a trapezoid when viewed from the side. The body 301 has a base connected to the boom 110 and the body 301 tapers downward to a bottom edge. The bottom edge has a shorter length than the base connected to the boom 110.

Alternatively, referring to FIG. 29, the body 301 has a trapezoid shape with edges that slope downward and back toward the rear end of the helicopter 1. When the body 301 is substantially at the end of the boom 110, the rear end of the body 301 is substantially at the same position as the outer circumference of the tail rotor 6.

The attachment means of the body 301 to the boom 110 can include two square shaped ring complementary to the square cross shape of the boom 110. The square shaped rings have four side surfaces as similarly described above and are located substantially at the front and the back of the body 301. There are also holes 215*a* and 215*b* that are in the surface 209*a* and 209*b*. The holes 215*a* and 215*b* can be created as described above and are for providing a piece of the surfaces

209*a* and 209*b* that frictionally engages the boom 110 that partially hold the element 300 in place during flight or inclination.

Represented in FIGS. 28-29, by way of example, the helicopter 1 does not include a downwardly directed stabilizer, such as downwardly directed stabilizer 108 described above. Thus, according to this embodiment the element 300 acts as a movable downwardly directed stabilizer or tail fin. Therefore, during flight, the main rotor 4 will exert a force on the body 301 in the form of air flow on the movable body 301. This force thus counteracts a portion of the turning moment induced by torque of the main rotor 4.

In another embodiment, an element movable for changing the center of gravity of a toy helicopter can be mechanically adjusted, in accordance with the present disclosure. The element can be movable by a servo or a motor. The element can a part of the helicopter, such as the battery or the element can be an additional piece of material that has weight or mass. This embodiment would allow a user to be able to remotely control the element's position relative to the center of gravity of the helicopter, thereby adjusting the center of gravity and controlling the helicopter's flight characteristics.

The element 200 can be utilized by and configured to adjust the center of gravity of any toy helicopter and, thereby change the helicopter's velocity. Referring to FIGS. 1-12, the element 200 can be configured to slidably attach to tail 3 of helicopter 1. Referring to FIGS. 13-18, the element 200 can be configured to slidably attach to the tail 3 of a helicopter 1 that has a downwardly directed stabilizer 108 that extends along the length of the tail 3.

The present disclosure is not limited to the embodiments described as an example and represented in the accompanying figures. Many different variations in size and scope and features are possible. For instance, instead of electrical motors being provided, other forms of motorized power are possible. A different number of blades may be provided to the rotors. The element 200 may be attached to helicopter 1 along a dedicated center of gravity adjusting system that is not attached to the boom 110. A helicopter utilizing the element 200 may only have a single rotor and no auxiliary rotor and, in other instances and configurations, may not necessitate a tail rotor. The element 200 may be enlarged to incorporate a larger fin for counteracting a larger portion of the turning moment induced by torque of the main rotor. The shape of the body 2 and the element 200 can be configured into different shapes while still being complimentary in shape. In other instances, the body 2 and the element 200 may not be complimentary.

A portion of the leading or forward edge of the fin and the trailing edge of the fin can be about complementary, such that their angular relationship is almost the same. When the fin is located in the rear position in close relationship with the tail there is less overlap of fin and tail because of this geometrical shape and at the same time there is an apparent increased size of the fin/tail combination. In some other cases the shape of the boom can be different in cross-section. Also the boom may have a draping on it.

In yet other forms the fin may be removable from the boom so that the different flying characteristics are developed. The integrated structure with the built in movable fin however allows for the helicopter to be mass fabricated and set up to operate within different predetermined design characteristics.

A helicopter according to the disclosure can be made in all sorts of shapes and dimensions while still remaining within the scope of the disclosure. In this sense although the helicopter in some senses has been described as toy or model helicopter, the features described and illustrated can have use in part or whole in a full-scale helicopter.

What is claimed is:

1. A remote control toy helicopter comprising:

a body and a longitudinal extension from the body;

a main motor and a battery for the main motor, the main motor being controllable by a controller remote from the body;

a main rotor having two propeller blades mounted on a rotor shaft driven by the main motor;

an auxiliary rotor mounted on the rotor shaft of the main rotor for rotation in the sense of the main rotor;

a movable fin attached along the longitudinal extension;

a weight fixed to the movable fin;

wherein selective movement to different operating positions of the movable fin along the longitudinal extension of a remote control toy helicopter changes the center of gravity of the remote control toy helicopter; and wherein the movable fin has an undercut substantially complimentary in shape to a portion of the body and wherein the movable fin in a forward position is substantially located under the body.

2. The remote control toy helicopter of claim 1, wherein the movable fin is attached to a boom of the remote control toy helicopter to extend downwardly from the boom and being for slidable adjustment along the length of the boom.

3. The remote control toy helicopter of claim 1, including a discreet weight element having a defined area mounted on the fin, the fin being a planar flat element and the weight being mounted on the planar flat element at a location removed from the boom, and there being planar material of the fin located as a defined space larger than the defined area occupied by the weight element between the boom and the weight element.

4. The remote control toy helicopter of claim 1, wherein the boom has a downwardly directed non-removable stabilizer and wherein the movable fin in a rearward position overlaps a portion of the downwardly directed stabilizer.

5. The remote control toy helicopter of claim 3, wherein air flow from the main rotor exerts pressure on the movable fin for counteracting a turning moment induced by torque of the main rotor.

6. A remote control toy helicopter comprising:

a body;

a longitudinal extension extending rearwardly from the body;

a main motor and a battery for the main motor, the main motor being controllable by a controller remote from the body;

a main rotor having two propeller blades mounted on a rotor shaft driven by the main motor;

an auxiliary rotor mounted on the rotor shaft of the main rotor for rotation in the sense of the main rotor;

a tail rotor mounted remotely from the body;

a movable fin attached along the longitudinal extension;

wherein selective movement to different operating positions of the movable fin along a longitudinal extension from the body to the tail rotor location changes the center of gravity of the remote control toy helicopter;

the movable fin having a substantially complimentary shape to a portion of the body adjacent to the longitudinal extension; and wherein the movable fin in a forward position is substantially located adjacent to the body, and in a rear position is remote from the body and adjacent a tail rotor.

* * * * *